US006138468A

United States Patent [19]

Yokomachi et al.

[11] Patent Number: 6,138,468

[45] Date of Patent: Oct. 31, 2000

[54] METHOD AND APPARATUS FOR CONTROLLING VARIABLE DISPLACEMENT COMPRESSOR

[75] Inventors: Naoya Yokomachi; Yoshiyuki Nakane; Tatsuya Koide; Toshiro Fujii, all of Kariya, Japan

[73] Assignee: Kabushiki Kaisha Toyoda Jidoshokki Seisakusho, Kariya, Japan

[21] Appl. No.: 09/243,715

[22] Filed: Feb. 3, 1999

[30] Foreign Application Priority Data

Feb. 6, 1998 [JP] Japan ..... 10-026050
Feb. 6, 1998 [JP] Japan ..... 10-026051

[51] Int. Cl.[7] ..... F25B 49/00

[52] U.S. Cl. ..... 62/228.5; 62/209; 62/229; 236/91 C

[58] Field of Search ..... 62/228.5, 229, 62/208, 209, 228.1; 236/91 R, 91 C

[56] References Cited

U.S. PATENT DOCUMENTS 4,330,999 5/1982 Nakayama ..... 62/217
4,687,419 8/1987 Suzuki et al. ..... 417/222
4,778,238 10/1988 Kikuchi et al. ..... 417/222
4,780,059 10/1988 Taguchi ..... 417/222
4,880,356 11/1989 Suzuki et al. ..... 417/53
4,882,909 11/1989 Terauchi ..... 62/209
4,905,477 3/1990 Takai ..... 62/196.3
5,014,522 5/1991 Noji et al. ..... 62/227
5,065,589 11/1991 Taguchi ..... 62/161
5,189,886 3/1993 Terauchi ..... 62/228.5
5,653,119 8/1997 Kimura et al. ..... 62/228.5
5,823,000 10/1998 Takai ..... 62/133

*Primary Examiner*—William Doerrler
*Assistant Examiner*—Marc Norman
*Attorney, Agent, or Firm*—Morgan & Finnegan, L.L.P.

[57] ABSTRACT

A variable displacement compressor in a refrigeration circuit using carbon dioxide refrigerant. The compressor changes the inclination of a swash plate located in a control chamber in accordance with the difference between the pressure in the control chamber and the pressure in a suction chamber thereby varying the compressor displacement. The compressor includes a control valve that adjusts the difference between the pressure in the control chamber and the pressure in the suction pressure. The control valve controls the flow rate of refrigerant supplied from the discharge chamber to the control chamber thereby adjusting the pressure difference. A controller inputs information from the outside of the refrigeration circuit. The outside information includes the outside temperature, the temperature of a passenger compartment and a target compartment temperature set by a temperature adjuster. The controller sets a target value of the pressure of refrigerant discharged from the compressor in accordance with the outside information. The controller then controls the current supplied to the control valve such that the target discharge pressure is rapidly reached. The compressor reduces unnecessary operation thereby reducing the power consumption and the load.

21 Claims, 12 Drawing Sheets

METHOD AND APPARATUS FOR CONTROLLING VARIABLE DISPLACEMENT COMPRESSOR

BACKGROUND OF THE INVENTION

The present invention relates to a variable displacement compressor used in a refrigeration circuit that performs heat exchange at temperatures both above and below the critical temperature of the refrigerant. Specifically, the present invention pertains to a method and an apparatus for controlling a variable displacement compressor that changes its displacement based on the difference between a control pressure in a control chamber and a suction pressure in a suction pressure zone.

A variable displacement compressor used in a refrigeration circuit generally has a housing that houses a control chamber and a rotatable drive shaft. Cylinder bores extend through a cylinder block, which forms part of the housing. A piston is reciprocally retained in each cylinder bore. A swash plate is tiltably supported on the drive shaft in the control chamber. The swash plate converts rotation of the drive shaft into reciprocation of the pistons. This draws refrigerant gas into the associated cylinder bore from a suction chamber, compresses the refrigerant gas, and then discharges the compressed refrigerant gas into a discharge chamber. The inclination of the swash plate is altered in accordance with the difference between the pressure of the cylinder bores and the pressure of the control chamber. In other words, the swash plate's inclination is altered in accordance with the difference between the suction pressure and the control pressure. The inclination of the swash plate is smaller when the pressure difference is larger. That is, the inclination of the swash plate decreases as the control pressure becomes higher relative to the suction pressure. A decrease in the inclination of the swash plate shortens the stroke of the pistons and decreases the displacement of the compressor.

A typical refrigeration circuit having the above compressor further includes a condenser, an expansion valve and an evaporator. The compressor compresses gaseous refrigerant sent from the evaporator. The condenser receives high pressure, high temperature gaseous refrigerant from the compressor. The condenser then cools the refrigerant by performing heat exchange with the outside air thereby liquefying the refrigerant. The expansion valve receives the liquefied refrigerant from the condenser and expands the refrigerant into low temperature, low pressure mist. The evaporator gasifies the refrigerant mist by performing heat exchange between the refrigerant and air to be sent to the passenger compartment.

A typical refrigeration circuit uses chlorofluorocarbon as its refrigerant. However, Japanese Unexamined Patent Publication No. 8-110104 describes a compressor that employs carbon dioxide ($CO_2$) as its refrigerant. The critical temperature of carbon dioxide is thirty-one degrees centigrade, which is about twenty degrees lower than that of chlorofluorocarbon. In a refrigeration circuit using chlorofluorocarbon as the refrigerant, the condenser cools chlorofluorocarbon refrigerant to temperatures below the critical temperature of the chlorofluorocarbon. However, in a refrigeration circuit using carbon dioxide as the refrigerant, the carbon dioxide can be cooled in a temperature range higher than the critical temperature of carbon dioxide especially in summer, when the outside temperature is high.

A refrigeration circuit that uses chlorofluorocarbon as its refrigerant includes a temperature-type expansion valve.

When the speed of the compressor's drive shaft increases while the thermal load applied on the circuit remains constant, the compressor increases the amount of refrigerant discharged therefrom. This increases the flow rate of the chlorofluorocarbon refrigerant in the circuit and prevents the evaporator from performing sufficient heat exchange. Accordingly, the degree of superheating of the chlorofluorocarbon refrigerant decreases at the outlet of the evaporator. The temperature-type expansion valve reduces the flow rate of chlorofluorocarbon refrigerant supplied to the evaporator in accordance with a decrease of the degree of superheating. The reduction of refrigerant flow rate allows the evaporator to perform sufficient heat exchange. As a result, the degree of superheating is maintained at a proper level. Consequently, the pressure of refrigerant supplied from the evaporator to the compressor is lowered. That is, the suction pressure is lowered. A decrease of the suction pressure results in a greater difference between the suction pressure and the control pressure, which, in turn, decreases the compressor displacement. The decrease of the displacement maintains the refrigerant performance of the refrigeration circuit. The decrease of the suction pressure also lowers the evaporating temperature of the chlorofluorocarbon refrigerant. Thus, the compressor can be optimally controlled in accordance with fluctuations in its suction pressure by referring to the temperature or the pressure of the refrigerant at the outlet of the evaporator.

In a refrigeration circuit using carbon dioxide as the refrigerant, the condenser can cool carbon dioxide refrigerant in a temperature range above the critical temperature of carbon dioxide. This indicates that the pressure of the refrigerant in the condenser changes in accordance with thermal load applied to the refrigeration circuit even if the temperature of the refrigerant in the condenser is the same. Thus, a carbon dioxide type refrigeration circuit includes a pressure-type expansion valve. The pressure-type expansion valve controls the flow rate of refrigerant in accordance with the temperature and pressure of refrigerant in the condenser, or the temperature and the pressure of refrigerant discharged from the compressor.

For example, an increase in the speed of the compressor's drive shaft with a constant thermal load acting on the refrigeration circuit raises the pressure of refrigerant discharged from the compressor, or discharge pressure. However, a pressure-type expansion valve increases the flow rate of carbon dioxide refrigerant supplied to the evaporator as the discharge pressure increases, which prevents the suction pressure of the compressor from dropping quickly. Thus, the displacement of the compressor is not decreased immediately. Accordingly, the refrigerant performance of the circuit is not adjusted promptly. Further, the evaporating temperature of the carbon dioxide refrigerant in the evaporator is not quickly lowered. Therefore, it is difficult to optimally control the compressor in accordance with fluctuations of the suction pressure by referring to the temperature and the pressure of the carbon dioxide refrigerant at the outlet of the evaporator. Thus, the use of a pressure-type expansion valve in a carbon dioxide refrigeration circuit increases unnecessary operation of the compressor thereby increasing the power consumption of the compressor and the load acting on the compressor.

SUMMARY OF THE INVENTION

Accordingly, it is an objective of the present invention to reduce power consumption and load in a variable displacement compressor used in a refrigeration circuit that performs heat exchange above and below the critical temperature of the refrigerant.

To achieve the foregoing and other objectives and in accordance with the purpose of the present invention, a variable displacement compressor is provided. The compressor is used in a refrigeration circuit that performs heat exchange at temperatures above and below the critical temperature of refrigerant. The compressor includes a suction pressure zone, a discharge pressure zone, a control chamber and a control valve. The pressure of the suction pressure zone is the pressure of refrigerant drawn into the compressor from a refrigeration circuit. The pressure of the discharge pressure zone is the pressure of refrigerant discharged from the compressor into the refrigeration circuit. The pressure of the control chamber is a control pressure. The control valve controls the difference between the control pressure in the control chamber and the suction pressure in the suction pressure zone thereby controlling the compressor displacement, which represents the flow rate of refrigerant in the refrigeration circuit. The control valve controls at least one of the flow rate of refrigerant supplied from the discharge pressure zone to the control chamber and the flow rate of refrigerant released from the control chamber to the suction pressure zone thereby controlling the difference between the control pressure and the suction pressure. The compressor further includes means for obtaining information required for controlling the compressor displacement from outside of the refrigeration circuit, means for setting a target value of flow rate of refrigerant in the refrigeration circuit in accordance with the information and a controller for controlling the control valve such that the target value is sought.

The present invention is also embodied in a method for controlling a variable displacement compressor used in a refrigeration circuit that performs heat exchange at temperatures above and below the critical temperature of refrigerant. The compressor includes a suction pressure zone, the pressure of which is the pressure of refrigerant drawn into the compressor from a refrigeration circuit, a discharge pressure zone, the pressure of which is the pressure of refrigerant discharged from the compressor into the refrigeration circuit, and a control chamber, the pressure of which is a control pressure. The method includes steps of controlling the difference between the control pressure in the control chamber and the suction pressure in the suction pressure zone using a control valve thereby controlling the compressor displacement, which represents the flow rate of refrigerant in the refrigeration circuit, obtaining information required for controlling the compressor displacement from outside of the refrigeration circuit, setting a target value of flow rate of refrigerant in the refrigeration circuit in accordance with the information, and controlling the control valve such that the target value is sought.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

Figure 1:
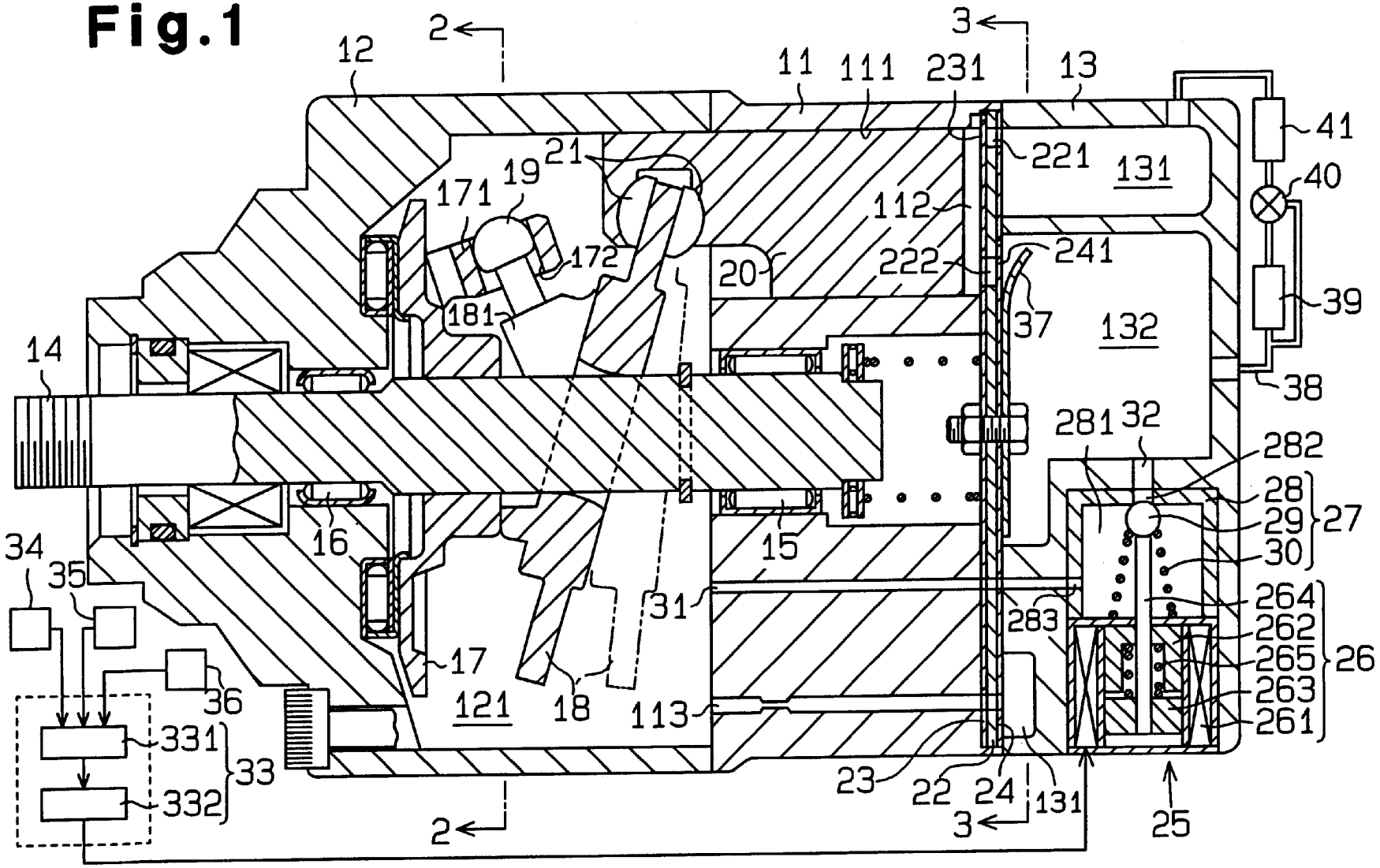
FIG. 1 is a cross-sectional view showing a compressor according to a first embodiment of the present invention.

A variable displacement compressor according to a first embodiment of the present invention will now be described with reference to FIGS. 1 to 7. As shown in FIG. 1, a front housing 12 and a rear housing 13 are fixed to a cylinder block 11. The cylinder block 11 and the front housing 12 rotatably support a drive shaft 14 by means of radial bearings 15, 16. The drive shaft 14 is operably coupled to an external drive source such as a vehicle engine by an electromagnetic clutch (not shown). The clutch selectively transmits the power of the engine to the drive shaft 14. A control chamber 121 is defined in the front housing 12 in front of the cylinder block 11.

Figure 2:
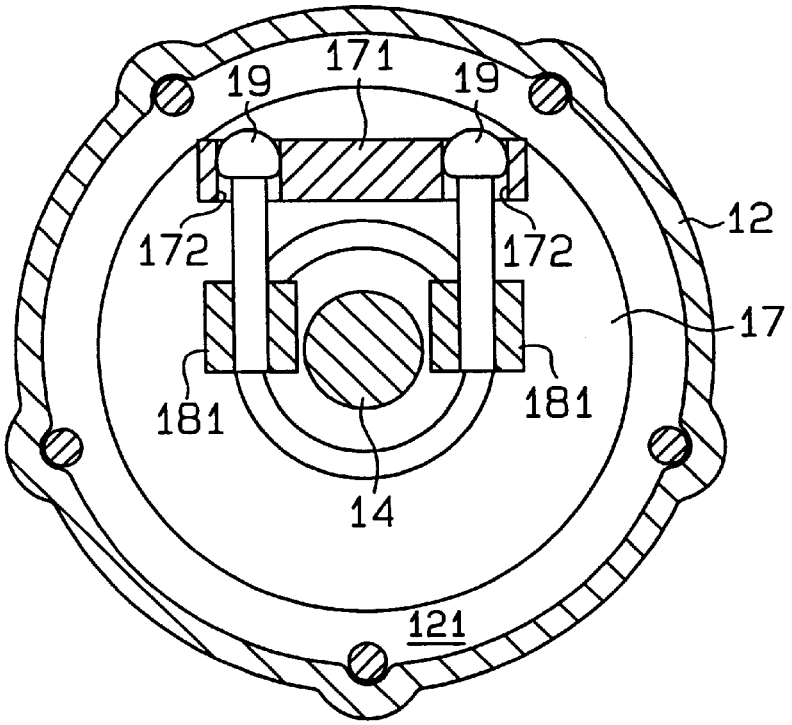
FIG. 2 is a cross-sectional view taken along line 2—2 in FIG. 1.

As shown in FIGS. 1 and 2, a disk-like rotor 17 is fixed to the drive shaft 14 in the control chamber 121. A support arm 171 having a pair of guide bores 172 extends from the peripheral portion of the rotor 17. A swash plate 18 is supported on the drive shaft 14 in the control chamber 121. The swash plate 18 is permitted to incline with respect to and slide along the drive shaft 14. A pair of guide arms 181 are attached to the swash plate 18. A guide pin 19 is secured to the distal end of each guide arm 181. Each guide pin 19 engages and slides within the associated guide bore 172. The engagement between the guide bores 172 and the associated guide pins 19 guides the inclination of the swash plate 18 and rotates the swash plate 18 integrally with the drive shaft 14.

Cylinder bores 111 extend through the cylinder block 11. Each cylinder bore 111 accommodates a piston 20. Each piston 20 defines a compression chamber 112 in the associated cylinder bore 111. The piston 20 is coupled to the swash plate 18 by a pair of shoes 21. Rotation of the swash plate 18 is converted into reciprocation of the piston 20 in the cylinder bore 111 by means of the shoes 21.

Figure 3:
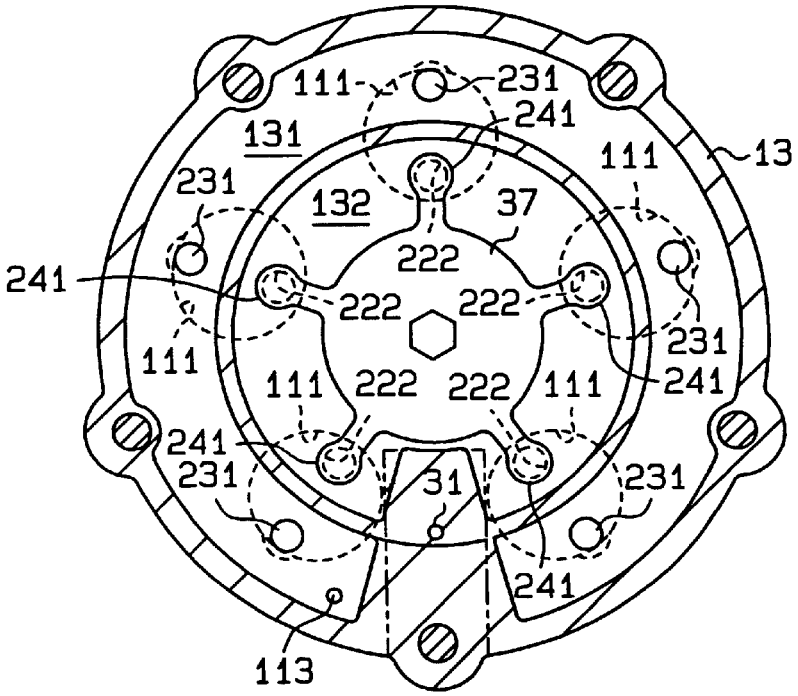
FIG. 3 is a cross-sectional view taken along line 3—3 in FIG. 1.

As shown in FIGS. 1 and 3, a suction chamber 131 and a discharge chamber 132 are defined in the rear housing 13. A partition plate 22 and a pair of valve plates 23, 24 are arranged between the cylinder block 11 and the rear housing 13. A suction port 221 and a discharge port 222 are provided for each cylinder bore 111 on the partition plate 22. A suction flap 231 is provided for each suction port 221 on the valve plate 23 to open and close the suction port 221. A discharge flap 241 is provided for each discharge port 222 on the valve plate 24 to open and close the discharge port 222. A retainer 37 limits the opening degree of the discharge flap 241.

When each piston 20 moves from its top dead center position to its bottom dead center position, refrigerant gas is drawn into the corresponding suction port 221 from the suction chamber 131 thereby opening the suction flap 231 to enter the associated compression chamber 112. When the piston 20 moves from the bottom dead center position to the top dead center position, the refrigerant gas compressed in the compression chamber 112 opens the corresponding discharge flap 241 and flows into the discharge chamber 132 through the associated discharge port 222.

The compressor constitutes a part of a refrigeration circuit 38. The refrigeration circuit 38 includes a condenser 39, a pressure-type expansion valve 40 and an evaporator 41. The condenser 39 receives high-pressure, high-temperature gaseous refrigerant from the discharge chamber 132 of the compressor. The condenser 39 then cools the refrigerant by transforming heat to the outside air thereby liquefying the refrigerant. The expansion valve 40 receives the liquefied refrigerant from the condenser 39 and expands the refrigerant into low temperature, low pressure mist. The evaporator 41 gasifies refrigerant mist by performing heat exchange between the refrigerant and air to be sent to the passenger compartment. The gasified refrigerant is drawn into the suction chamber 131 of the compressor. The expansion valve 40 adjusts the flow rate of refrigerant sent to the evaporator 41 in accordance with the pressure of the refrigerant discharged from the discharge chamber 132, or the discharge pressure Pd of the compressor.

Figure 5:
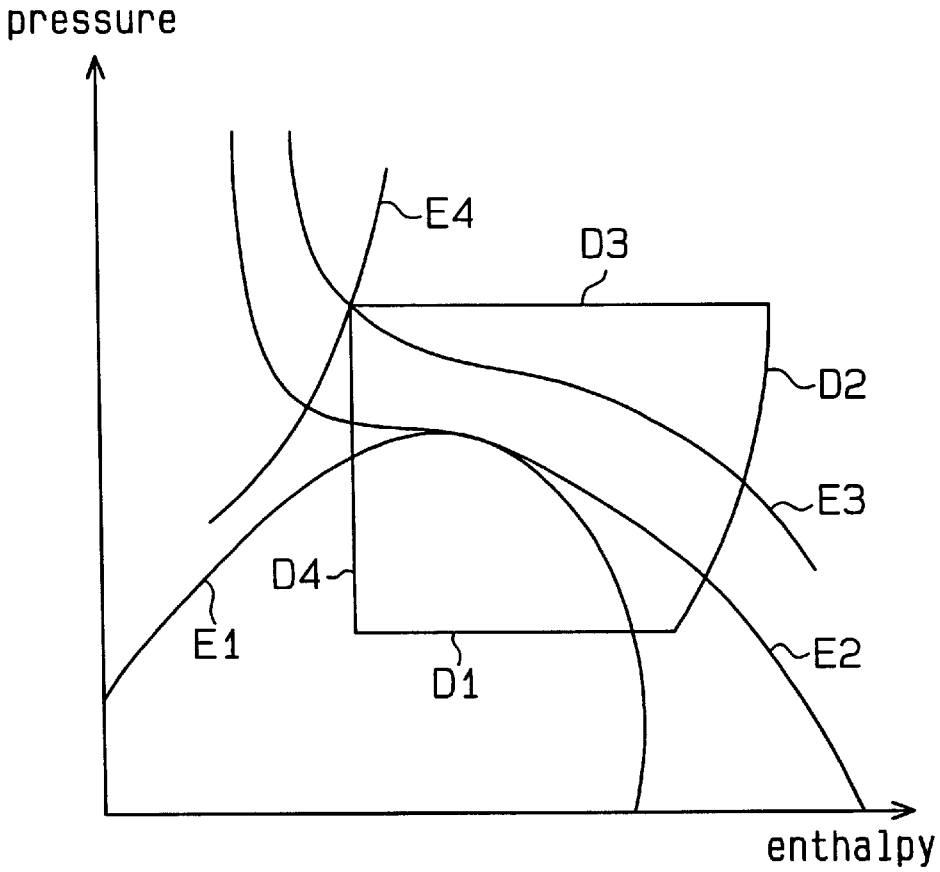
FIG. 5 is a Mollier diagram.

FIG. 5 is a Mollier diagram for carbon dioxide refrigerant. The horizontal axis represents enthalpy, and the vertical axis represents pressure. Line E1 represents a saturated liquid line and a saturated vapor line. Line E2 represents a critical temperature line of carbon dioxide. Line D1 represents the evaporation phase in the evaporator 41. Line D2 represents the compression phase, or the compression stroke, of the compressor. Line D3 represents the condensation phase, which occurs in the condenser 39. Line D4 represents the expansion phase, which is caused by in the expansion valve 40. In the example of FIG. 5, the outside temperature Te, which is represented by line E3, is higher than the critical temperature represented by the critical temperature line E2. Therefore, the condensation of carbon dioxide refrigerant is performed in a super-critical range, that is, at temperatures higher than the critical temperature.

The inclination of the swash plate 18 varies in accordance with the difference between the pressure of the control chamber 121 and the pressure of the compression chambers 112. More specifically, the difference between the pressure of the control chamber 121 (control pressure Pc) and the pressure of the suction chamber 131 (suction pressure Ps), or the pressure difference Pc−Ps, determines the inclination of the swash plate 18. In this compressor, the control pressure Pc is maintained at a value that is higher than the suction pressure Ps (Pc>Ps). An increase in the pressure difference Pc−Ps decreases the inclination of the swash plate 18. This shortens the stroke of each piston 20 and decreases the displacement of the compressor. On the other hand, a decrease in the pressure difference Pc−Ps increases the inclination of the swash plate 18. This lengthens the stroke of each piston 20 and increases the displacement.

As shown in FIG. 1, a displacement control valve 25 is arranged in the rear housing 13 to control the flow of refrigerant gas from the discharge chamber 132 to the control chamber 121. The refrigerant gas in the control chamber 121 flows through a pressure relief passage 113, which has a throttle, and then enters the suction chamber 131. The pressure in the control chamber 121, or the control pressure Pc, is determined by two factors. The first factor is the flow rate of refrigerant gas sent out of the control chamber 121 and into the suction chamber 131 through the relief passage 113. The second factor is the flow rate of refrigerant gas sent into the control chamber 121 from the discharge chamber 132 by way of the control valve 25.

Figure 4:
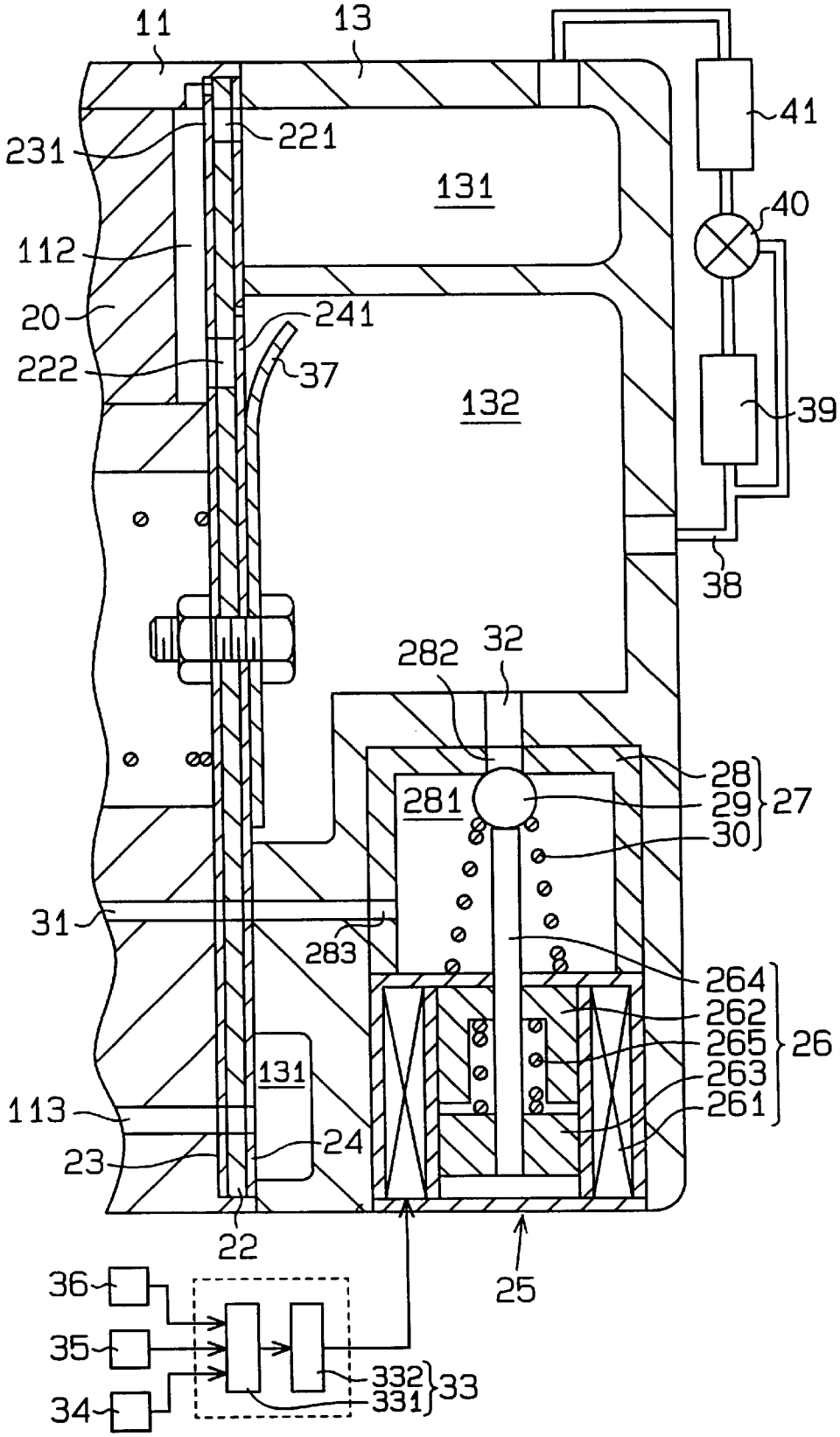
FIG. 4 is an enlarged cross-sectional view showing the displacement control valve of FIG. 1.

As shown in FIG. 4, the displacement control valve 25 has a solenoid 26 and a valve mechanism 27. The solenoid 26 includes a coil 261, a steel fixed core 262, a steel movable core 263, a drive rod 264, which is secured to the movable core 263, and a return spring 265. The valve mechanism 27 includes a case 28, a valve chamber 281 defined in the case 28, a valve body 29 accommodated in the valve chamber 281 and a support spring 30 for supporting the valve body 29.

When the coil 261 is supplied with electric current, an electromagnetic attractive force is generated between the movable core 263 and the fixed core 262. Thus, the drive rod 264, which is secured to the movable core 263, urges the valve body 29 in a direction closing the valve hole 282. The return spring 265 urges the movable core 263 away from the fixed core 262.

The case 28 includes a port 283. The valve chamber 281 is connected with the control chamber 121 by the port 283 and a passage 31. The valve hole 282 is connected with the discharge chamber by a passage 32. When the valve body 29 opens the valve hole 282, the high-pressure refrigerant gas in the discharge chamber 132 is sent to the control chamber 121 through a pressurizing passage, which is formed by the passage 32, the valve hole 282, the valve chamber 281 and the port 283.

A resultant force (Fo+F2) of the force Fo of the solenoid 26 and the urging force F2 of the support spring 30 urges the valve body 29 in the direction closing the valve hole 282. A resultant force (Pd1+F1) of the force Pd1 of the discharge pressure Pd acting on the valve body 29 and the urging force F1 of the return spring 265 acts against the resultant force Fo+F2. That is, the resultant force Pd1+F1 urges the valve 29 in the direction opening the valve hole 282. Thus, when the force Pd1 of the discharge pressure Pd acting on the valve body 29 is greater than the force Fo+F2−F1, the valve body 29 opens the valve hole 282 and allows high pressure refrigerant in the discharge chamber 132 to flow into the control chamber 121. On the other hand, when the force Pd1 is smaller than the force Fo+F2−F1, the valve body 29 closes the valve hole 282 and stops the flow of high pressure refrigerant from the discharge chamber 132 into the control chamber 121. In this manner, the control valve 25 controls the flow of refrigerant from the discharge chamber 132 to the control chamber 121.

When the current fed to the solenoid 26 is maintained at a constant value, that is, when the force Fo of the solenoid 26 is constant, the valve body 29 moves in accordance with fluctuations of the force Pd1, which is the force of the discharge pressure Pd acting on the valve body 29. More specifically, an increase in the discharge pressure Pd, or an increase in the force Pd1 increases the opened area of the valve hole 282 thereby increasing the amount of refrigerant flowing from the discharge chamber 132 to the control chamber 121. This raises the control pressure Pc in the control chamber 121 thereby increasing the difference between the control pressure Pc and the suction pressure Ps. Consequently, the inclination of the swash plate 18 decreases, which reduces the displacement of the compressor such that the discharge pressure Pd decreases.

When the discharge pressure Pd decreases, that is, when the force Pd1 decreases, the valve body 29 decreases the opened area of the valve hole 282 thereby reducing the amount of high pressure refrigerant from the discharge chamber 132 to the control chamber 121. This lowers the control pressure Pc in the control chamber 121 and thus decreases the difference between the control pressure Pc and the suction pressure Ps. Consequently, the inclination of the swash plate 18 increases, which increases displacement of the compressor such that the discharge pressure Pd increases.

In this manner, the control valve 25 functions to lower the discharge pressure Pd when the pressure Pd increases, and functions to increase the pressure Pd when the pressure Pd decreases. In other words, the control valve 25 directs the pressure Pd toward a predetermined, or target level.

The control valve 25 changes the predetermined level toward which the discharge pressure Pd is directed, or the value of the target discharge pressure, in accordance with the value of the current fed to the solenoid 26. For example, an increase in the value of the current fed to the solenoid 26 strengthens the force Fo of the solenoid 26 that urges the valve body 29 in the closing direction. This decreases the opened area of the valve hole 282 and lowers the control pressure Pc of the control chamber 121. As a result, the compressor displacement increases and the discharge pressure Pd is increased. The control valve 25 functions to seek the increased discharge pressure Pd. In this manner, the control valve 25 seeks a higher discharge pressure Pd as the value of the current fed to the solenoid 26 increases. That is, the control valve 25 functions to change the target discharge pressure in accordance with the value of the current fed to the solenoid 26.

A controller 33 illustrated in FIG. 4 controls electric current to the solenoid 26 of the control valve 25. The controller 33 is formed, for example, by a computer and includes a setter 331 for setting a target discharge pressure and a supplier 332 for supplying current to the solenoid 26. The supplier 332 controls the value of the current to the solenoid 26 in accordance with the target discharge pressure set by the setter 331. The setter 331 sets a target discharge pressure based on information from an outside temperature detector 34, which detects the outside temperature, a compartment temperature sensor 35, which detects the temperature in the passenger compartment, and a temperature adjuster 36. The driver sets a target compartment temperature with the temperature adjuster 36. The supplier 332 controls current to the solenoid 26 such that the set target discharge pressure is obtained.

Figure 6:
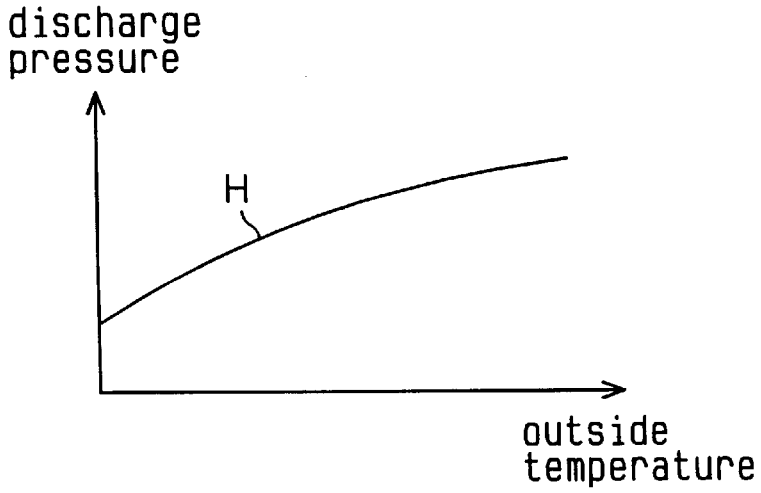
FIG. 6 is a graph showing the relationship between the outside temperature and a provisional target value of the discharge pressure.
Figure 7:
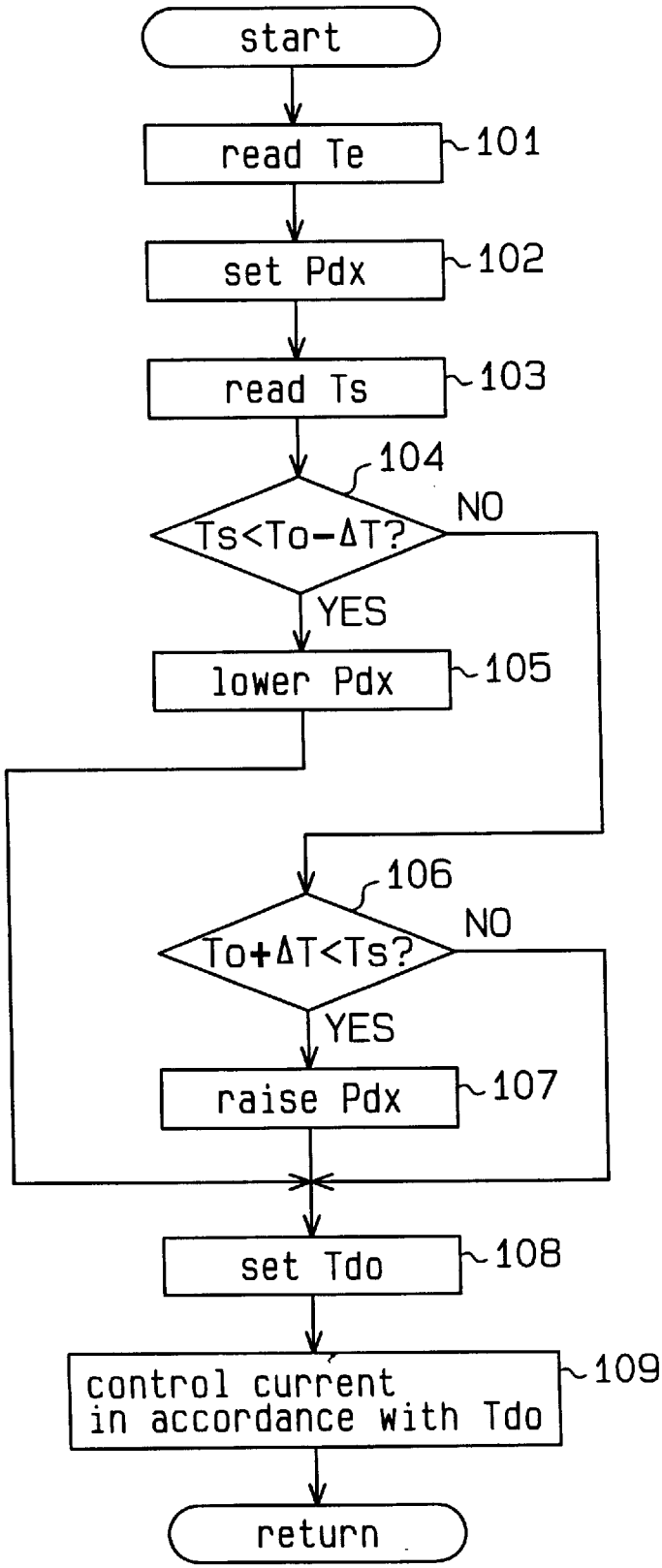
FIG. 7 is a flowchart illustrating a program for controlling the compressor of FIG. 1.

The controller 33 performs a program in FIG. 7 for controlling the compressor. The setter 331 of the controller 33 samples the outside temperature Te detected by the outside temperature sensor 34 and the compartment temperature Ts detected by the compartment temperature sensor 35 at every predetermined interval. Upon receiving the sampled outside temperature Te at step 101, the setter 331 moves to step 102. At step 102, the setter 331 provisionally determines a target discharge pressure Pdx. The provisional target discharge presser Pdx is the minimum value of the discharge pressure Pd. The line E4 in FIG. 5 is a data map representing the provisional target discharge pressure Pdx. The line H in FIG. 6 represents the relationship between the outside temperature Te and the provisional target discharge pressure Pdx. The setter 331 determines the provisional target discharge pressure Pdx using the map data of FIGS. 5 and 6. As shown in FIG. 6, the provisional target discharge pressure Pdx increases as the outside temperature Te, which is indicative of the thermal load acting on the refrigeration circuit 38, increases.

At step 103, the setter 331 reads the sampled compartment temperature Ts. In a subsequent step 104, the setter 331 judges whether the compartment temperature Ts is lower than the lowest value of an acceptable range. The acceptable range is determined based on a target compartment temperature To set by the temperature adjuster 36. Specifically, the acceptable range is from a temperature that is lower than the target temperature To by a predetermined value ΔT to a temperature that is higher than the target temperature by the value ΔT. That is, the acceptable range is between the temperatures To−ΔT and To+ΔT. If the compartment temperature Ts is lower than the lowest value (To−ΔT) in the acceptable range at step 104, the setter 331 judges that the thermal load applied to the refrigeration circuit 38 is relatively small for the current refrigeration performance of the circuit 38.

At step 105, the setter 331 decreases the value of the provisional target discharge pressure Pdx in accordance with the difference between the compartment temperature Ts and the lowest value (To−ΔT) in the acceptable range. At step 108, the setter 331 sets the provisional target discharge pressure Pdx as a target discharge pressure Pdo.

If the compartment temperature Ts is greater than the lowest value (To−ΔT) of the acceptable range at step 104, the setter 331 moves to step 106. At step 106, the setter 331 judges whether the compartment temperature Ts is higher than the highest value (To+ΔT) in the acceptable range. If the compartment temperature Ts is higher than the highest value (To+ΔT) in the acceptable range, the setter 331 judges that the thermal load applied to the refrigeration circuit 38 is relatively great for the current refrigeration performance of the circuit 38 and moves to step 107.

At step 107, the setter 331 raises the provisional target discharge pressure Pdx in accordance with the difference between the compartment temperature Ts and the highest value (To+ΔT) in the acceptable range. At a subsequent step 108, the setter 331 sets the raised value Pdx as the target discharge pressure Pdo.

If the compartment temperature Ts is equal to or lower than the highest value (To+ΔT) in the acceptable range at step 106, the setter 331 judges that the compartment temperature Ts is in the acceptable range, or that the current refrigerant performance of the circuit 38 is adequate. In this case, the setter 331 moves to step 108 without changing the provisional target discharge pressure Pdx. At step 108, the setter 331 sets the provisional target pressure Pdx as the target discharge pressure Pdo.

At step 109, the supplier 332 of the controller 33 controls current supplied to the solenoid 26 based on the target discharge pressure Pdo set in the previous steps. As the target discharge pressure Pdo is increased, the supplier 332 increases the current value supplied to the solenoid 26. As the target pressure Pdo is decreased, the supplier 332 decreases the current value supplied to the solenoid 26. The solenoid 26 produces an urging force in accordance with the supplied current value. Thus, the control valve 25 functions to seek the target discharge pressure Pdo, which is determined by the supplied current value.

A decrease in the thermal load applied on the circuit 38 lowers the target discharge pressure Pdo. The control valve 25 therefore functions to decrease the compressor displacement. On the other hand, an increase in the thermal load increases the target discharge pressure Pdo. The control valve 25 therefore functions to increase the compressor displacement.

As described above, the setter 331 of the controller 33 sets the target discharge pressure Pdo based on the outside temperature Te detected by the outside temperature sensor 34, the compartment temperature Ts detected by the compartment temperature sensor 35 and the target compartment temperature To set by the temperature adjuster 36. In other words, the sensor 331 obtains the thermal load and the refrigeration performance of the circuit 38 based on information from outside of the circuit 38. The setter 331 then quickly sets the target discharge pressure Pdo in accordance with the obtained thermal load and the refrigeration performance. The supplier 332 of the controller 33 controls the current supplied to the control valve 25 based on the target discharge pressure Pdo. The control valve 25 controls the flow of refrigerant from the discharge chamber 132 to the control chamber 121, that is, the control valve 25 controls the difference between the control pressure Pc in the control chamber 121 and the suction pressure Ps thereby controlling the compressor displacement.

The discharge pressure Pd of the refrigerant is a function of the compressor displacement, or a function of the flow rate of refrigerant in the circuit 38. Thus, the controller 33 sets the target flow rate of refrigerant in the refrigeration circuit 38 in accordance with the thermal load and the refrigeration performance of the circuit 38. The controller 33 then controls the current supplied to the control valve 25 thereby obtaining the target flow rate.

The speed of the drive shaft 14 is a function of the speed of the vehicle engine. Fluctuations of the engine speed fluctuate the speed of the drive shaft 14. This, in turn, fluctuates the compressor displacement, or the discharge pressure Pd. However, in the embodiment of FIGS. 1–7, the target discharge pressure Pdo is determined in accordance with information obtained from the outside of the circuit 38, and the discharge pressure Pd, which corresponds to the flow rate of the refrigerant in the refrigeration circuit 38, quickly seeks the target discharge pressure Pdo. This reduces unnecessary operation of the compressor thereby optimizing the power consumption of the compressor and the load acting on the compressor.

When the thermal load is increased, the refrigeration circuit 38 increases the flow rate of the refrigerant in the circuit 38 for enhancing its refrigeration performance. When the thermal load is decreased, the circuit 38 decreases the flow rate of the refrigerant in the circuit 38 for lowering its refrigeration performance. Therefore, the thermal load obtained based on the outside temperature Te, the compartment temperature Ts and the target temperature To is suitable information for quickly adjusting the flow rate of the refrigerant in the circuit 38.

The setter 331 sets the provisional target discharge pressure Pdx based on the outside temperature Te. The setter 331 judges whether the current compartment temperature Ts is in the acceptable range based on the current compartment temperature Ts and the target compartment temperature To. If the temperature Ts is out of the acceptable range, the setter 331 adjusts the provisional target discharge pressure Pdx for obtaining the target discharge pressure Pdo. In this manner, the target pressure Pdo is optimized for the current status and the compressor is optimally controlled.

The pressure-type expansion valve 40 controls the flow rate of the refrigerant in accordance with the discharge pressure Pd, thereby suppressing fluctuations of the discharge pressure Pd due to speed fluctuations of the drive shaft 14. Thus, the expansion valve 40 functions to allow the discharge pressure Pd to seek its target value even more quickly.

Since the outside temperature and the compartment temperature do not change suddenly, the controller 33 is not required to process data rapidly. Therefore, the control system of FIGS. 1–7 is inexpensively constructed.

A second embodiment of the present invention will now be described with reference to FIGS. 8 and 9. Like or the same reference numerals are given to those components that are like or the same as the corresponding components of the embodiment of FIGS. 1–7.

Figure 8:
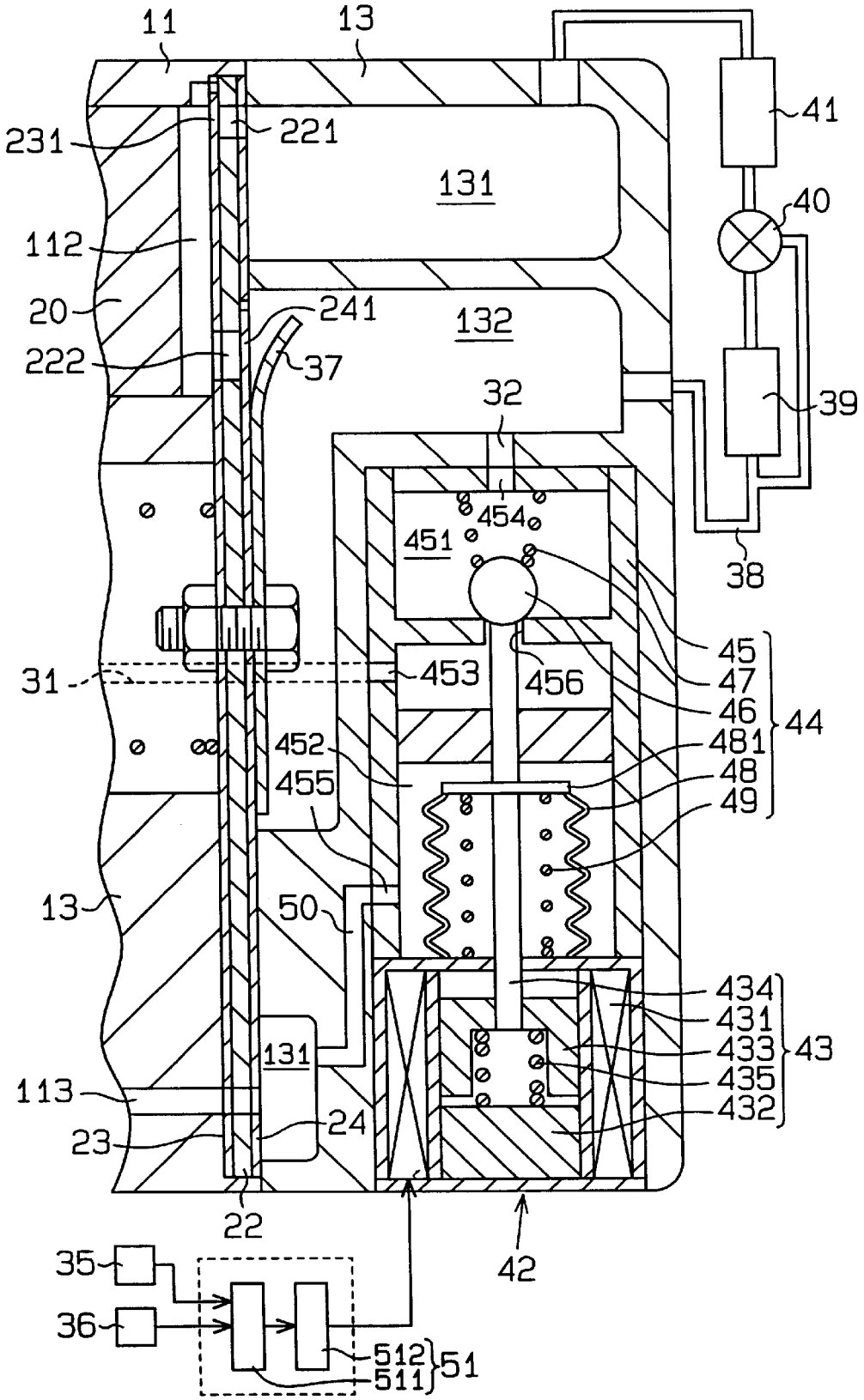
FIG. 8 is an enlarged partial cross-sectional view illustrating a compressor according to a second embodiment of the present invention.

As shown in FIG. 8, a control valve 42 according to the second embodiment includes a solenoid 43 and a valve mechanism 44. The solenoid 43 includes a coil 431, a steel fixed core 432, a steel movable core 433, a drive rod 434, which is secured to the movable core 433, and a return spring 435. The valve mechanism 44 includes a case 45, a valve chamber 451 defined in the case 45, a valve body 46 accommodated in the valve chamber 451, a support spring 47 for supporting the valve body 46, a pressure sensing chamber 452 defined in the case 45, a bellows 48 located in the pressure sensing chamber 452 and a spring 49. The bellows 48 includes a pressure sensing plate 481, which is coupled to the drive rod 434. The spring 49 urges the plate 481 in a direction expanding the bellows 48.

Suction pressure Ps in the suction chamber 131 communicates the pressure sensing chamber 452 by way of a passage 50 and a port 455. The plate 481 of the bellows 48 receives a force Ps1 of the suction pressure Ps in the pressure sensing chamber 452. The urging force of the spring 49 acts against the force Ps1. The movable core 433 is urged toward the fixed core 432 by a force corresponding to the value of current supplied to the coil 431. That is, the urging force of the solenoid 43 acts against the urging force of the spring 49. The return spring 435 urges the movable core 433 away from the fixed core 432.

The case 45 includes ports 453, 454 and 455. A valve hole 456 is connected to the control chamber 121 by way of the port 453 and the passage 31. The valve chamber 451 is connected to the discharge chamber 132 by way of the port 454 and the passage 32. The pressure sensing chamber 452 is connected to the suction chamber 131 by way of the port 455 and the passage 50. When the valve body 29 opens the valve hole 456, the high-pressure refrigerant in the discharge chamber 132 flows into the control chamber 121 through a pressurizing passage, which is formed by the passage 32, the port 454, the valve chamber 451, the valve hole 456, the port 453 and the passage 31.

A resultant force (Fo+F5+Ps1) of the force Fo of the solenoid 43, the urging force F5 of the support spring 47 and the force Ps1 of the suction pressure Ps acting on the bellows 48 urges the valve body 46 in a direction closing the valve hole 456. A resultant force (F3+F4) of the force F3 of the return spring 435 and the force F4 of the spring 49 acts against the resultant force Fo+F5+Ps1. That is, the resultant force F3+F4 urges the valve 46 in a direction opening the valve hole 456. Thus, when the force Ps1 of the suction pressure Ps acting on the bellows 48 is smaller than the force F3+F4−Fo−F5, the valve body 46 opens the valve hole 456 and allows high pressure refrigerant in the discharge chamber 132 to flow into the control chamber 121. On the other hand, when the force Ps1 is greater than the force F3+F4−Fo−F5, the valve body 46 closes the valve hole 456 and stops the flow of high pressure refrigerant from the discharge chamber 132 into the control chamber 121. In this manner, the control valve 42 controls the flow of refrigerant from the discharge chamber 132 to the control chamber 121.

When the current fed to the solenoid 43 is maintained at a constant value, that is, when the force Fo of the solenoid 43 is constant, the bellows 48 moves in accordance with fluctuations of the force Ps1, which is the force of the suction pressure Ps acting on the bellows 48. More specifically, as the suction pressure Ps is lowered, or as the force Ps1 is weakened, the valve body 46 increases the opened area of the valve hole 456 thereby increasing the amount of refrigerant flowing from the discharge chamber 132 to the control chamber 121. This increases the control pressure Pc in the control chamber 121 thereby increasing the difference between the control pressure Pc and the suction pressure Ps. Consequently, the inclination of the swash plate 18 decreases, which reduces the displacement of the compressor such that the suction pressure Ps increases.

When the suction pressure Ps is increased, that is, when the force Ps1 is strengthened, the valve body 46 decreases the opened area of the valve hole 456 thereby reducing the amount of high pressure refrigerant flowing from the discharge chamber 132 to the control chamber 121. This lowers the control pressure Pc in the control chamber 121 and thus decreases the difference between the control pressure Pc and the suction pressure Ps. Consequently, the inclination of the swash plate 18 increases, which increases displacement of the compressor such that the suction pressure Ps lowers.

In this manner, the control valve 42 functions to increase the suction pressure Ps when the pressure Ps decreases, and functions to lower the pressure Ps when the pressure Ps increases. In other words, the control valve 42 directs the pressure Ps toward a predetermined, or target level.

The control valve 42 changes the predetermined level to which the suction pressure Ps is directed, or the value of the target suction pressure, in accordance with the value of the current fed to the solenoid 43. For example, an increase in the value of the current fed to the solenoid 43 strengthens the force Fo of the solenoid 43 that urges the valve body 46 in the closing direction. This decreases the opened area of the valve hole 456 and lowers the control pressure Pc of the control chamber 121. As a result, the compressor displacement increases and the suction pressure Ps is lowered gradually. The control valve 42 functions to seek the lowered suction pressure Ps. In this manner, the control valve 42 seeks a lower suction pressure Ps as the value of the current fed to the solenoid 43 increases. That is, the control valve 42 functions to change the target suction pressure in accordance with the value of the current fed to the solenoid 43.

The controller 51 controls the current supplied to the solenoid 43 in the control valve 42. The controller 51 includes a setter 511 for setting the target suction pressure and a supplier 512 for supplying a current the solenoid 43. The setter 511 sets the target suction pressure based on information from the compartment temperature sensor 35 and the temperature adjuster 36. The supplier 512 controls current supplied to the solenoid 43 such that the set target suction pressure is obtained.

Figure 9:
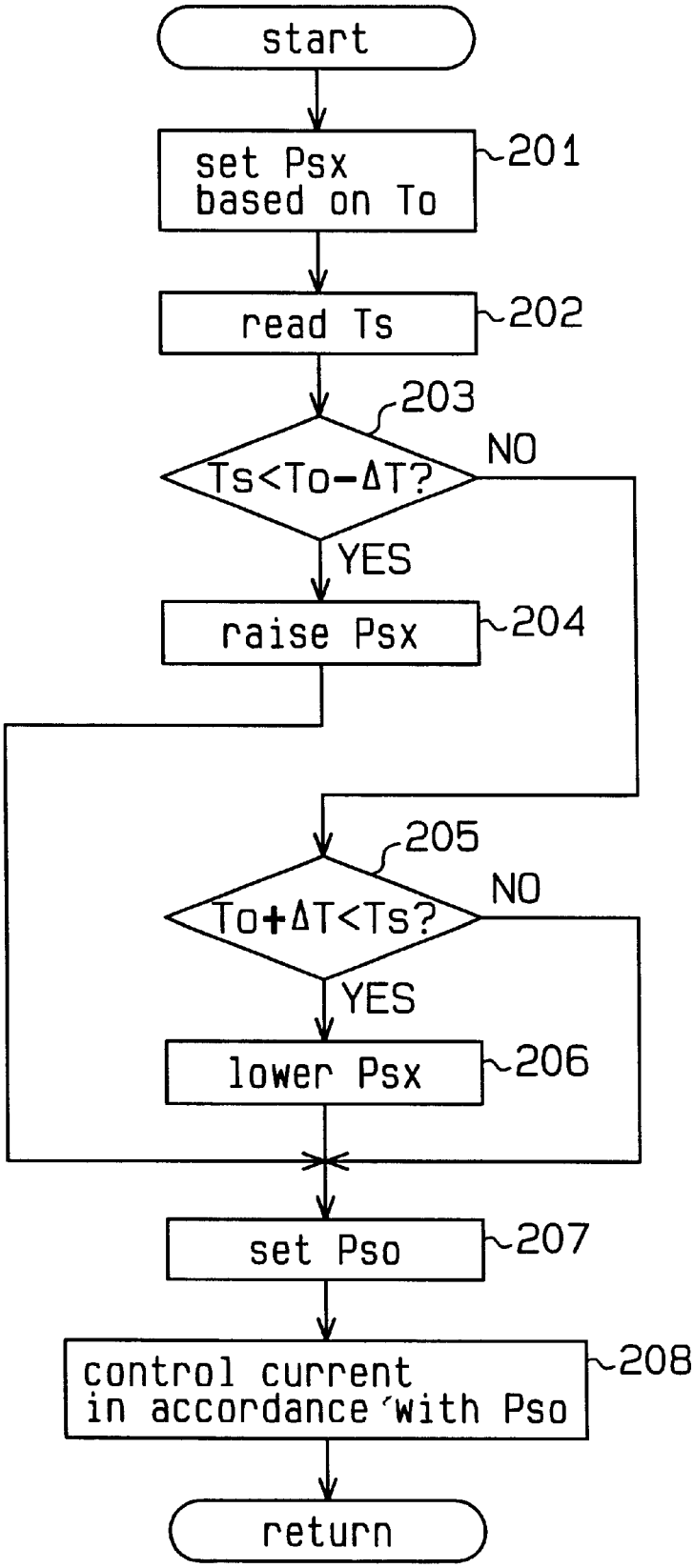
FIG. 9 is a flowchart illustrating a program for controlling the compressor of FIG. 8.

The controller 51 performs a program in FIG. 9 for controlling the compressor. At step 201, the setter 511 of the controller 51 provisionally determines the value of the target suction pressure Psx based on the target compartment temperature To set by the temperature adjuster 36.

At step 202, the setter 511 reads the sampled compartment temperature Ts. As in the same manner in step 104 of FIG. 7, the setter 511 judges whether the compartment temperature Ts is lower than the lowest the value (To−ΔT) of the acceptable range, which is determined based on the target compartment temperature To. If the compartment temperature Ts is lower than the lowest value (To−ΔT) of the acceptable range, the setter 511 judges that the thermal load applied to the refrigeration circuit 38 is relatively small for the current refrigeration performance of the circuit 38 and moves to step 204.

At step 204, the setter 511 increases the value of the provisional target suction pressure Psx in accordance with the difference between the compartment temperature Ts and the lowest value in the acceptable range (To−ΔT). At step 207, the setter 511 sets the provisional target pressure Psx as a target suction pressure Pso.

If the compartment temperature Ts is greater than the lowest value (To−ΔT) of the acceptable range at step 203, the setter 551 moves to step 205. In the same manner as step 106 of FIG. 7, the setter 551 judges whether the compartment temperature Ts is higher than the highest value (To+ΔT) of the acceptable range at step 205. If the compartment temperature Ts is higher than the highest value (To+ΔT) of the acceptable range, the setter 511 judges that the thermal load applied to the refrigeration circuit 38 is relatively great for the current refrigeration performance of the circuit 38 and moves to step 206.

At step 206, the setter 511 lowers the provisional target suction pressure Psx in accordance with the difference between the compartment temperature Ts and the highest value (To+ΔT) in the acceptable range. At a subsequent step 207, the setter 511 sets the lowered value Psx as the target suction pressure Pso.

If the compartment temperature Ts is equal to or lower than the highest value (To+ΔT) at step 205, the setter 511 judges that the compartment temperature Ts is in the acceptable range, or that the current refrigerant performance of the circuit 38 is sufficient. In this case, the setter 511 moves to step 207 without changing the provisional target suction pressure Psx. At step 207, the setter 511 sets the provisional target pressure Psx as the target discharge pressure Pso.

At step 208, the supplier 512 of the controller 51 controls current supplied to the solenoid 43 based on the target suction pressure Pso set in the previous steps. As the target suction pressure Pso is raised, the supplier 512 decreases the current value supplied to the solenoid 43. As the target pressure Pso is lowered, the supplier 512 increases the current value supplied to the solenoid 43. The solenoid 43 produces an urging force in accordance with the supplied current. Thus, the control valve 42 functions to seek the target suction pressure Pso, which is determined by the value of the supplied current.

A decrease in the thermal load applied to the circuit 38 raises the target suction pressure Pso. The control valve 42 therefore functions to decrease the compressor displacement. On the other hand, an increase in the thermal load lowers the target suction pressure Pso. The control valve 42 therefore functions to increase the compressor displacement.

As described above, the setter 511 of the controller 51 sets the target suction pressure Pso based on the compartment temperature Ts detected by the compartment temperature sensor 35 and the target compartment temperature To set by the temperature adjuster 36. In other words, the sensor 511 obtains the thermal load and the refrigeration performance of the circuit 38 based on information from outside of the circuit 38. The setter 511 then quickly sets the target suction pressure Pso in accordance with the obtained thermal load and the refrigeration performance. The supplier 512 of the controller 51 controls the current supplied to the control valve 42 based on the target suction pressure Pso. The control valve 42 controls the flow of refrigerant from the discharge chamber 132 to the control chamber 121, that is, the control valve 42 controls the difference between the control pressure Pc in the control chamber 121 and the suction pressure Ps such that the target suction pressure Pso is obtained. The compressor displacement is controlled, accordingly.

The suction pressure Ps of the refrigerant drawn into the compressor is a function of the compressor displacement, or a function of the flow rate of refrigerant in the circuit 38. Thus, the controller 51 sets a target flow rate of refrigerant in the refrigeration circuit 38 in accordance with the thermal load and the refrigeration performance of the circuit 38. The controller 51 then controls the current supplied to the control valve 42 thereby obtaining the target flow rate.

Fluctuations of the engine speed fluctuate the speed of the drive shaft 14. This, in turn, fluctuates the compressor displacement, or the suction pressure Ps. However, in the embodiment of FIGS. 8 and 9, the suction pressure Ps, which corresponds to the flow rate of the refrigerant in the refrigeration circuit 38, quickly seeks the target suction pressure Pso, which is determined in accordance with information obtained from the outside of the circuit 38. Therefore, as in the embodiment of FIGS. 1–7, the embodiment of FIGS. 8 and 9 reduces unnecessary operation of the compressor thereby reducing the power consumption of the compressor and the load acting on the compressor. The compressor of FIGS. 8 and 9 shares the other advantages with the compressor of FIGS. 1–7.

A third embodiment of the present invention will now be described with reference to FIGS. 10–12. Like or the same reference numerals are given to those components that are like or the same as the corresponding components of the embodiment of FIGS. 1–7.

Figure 10:
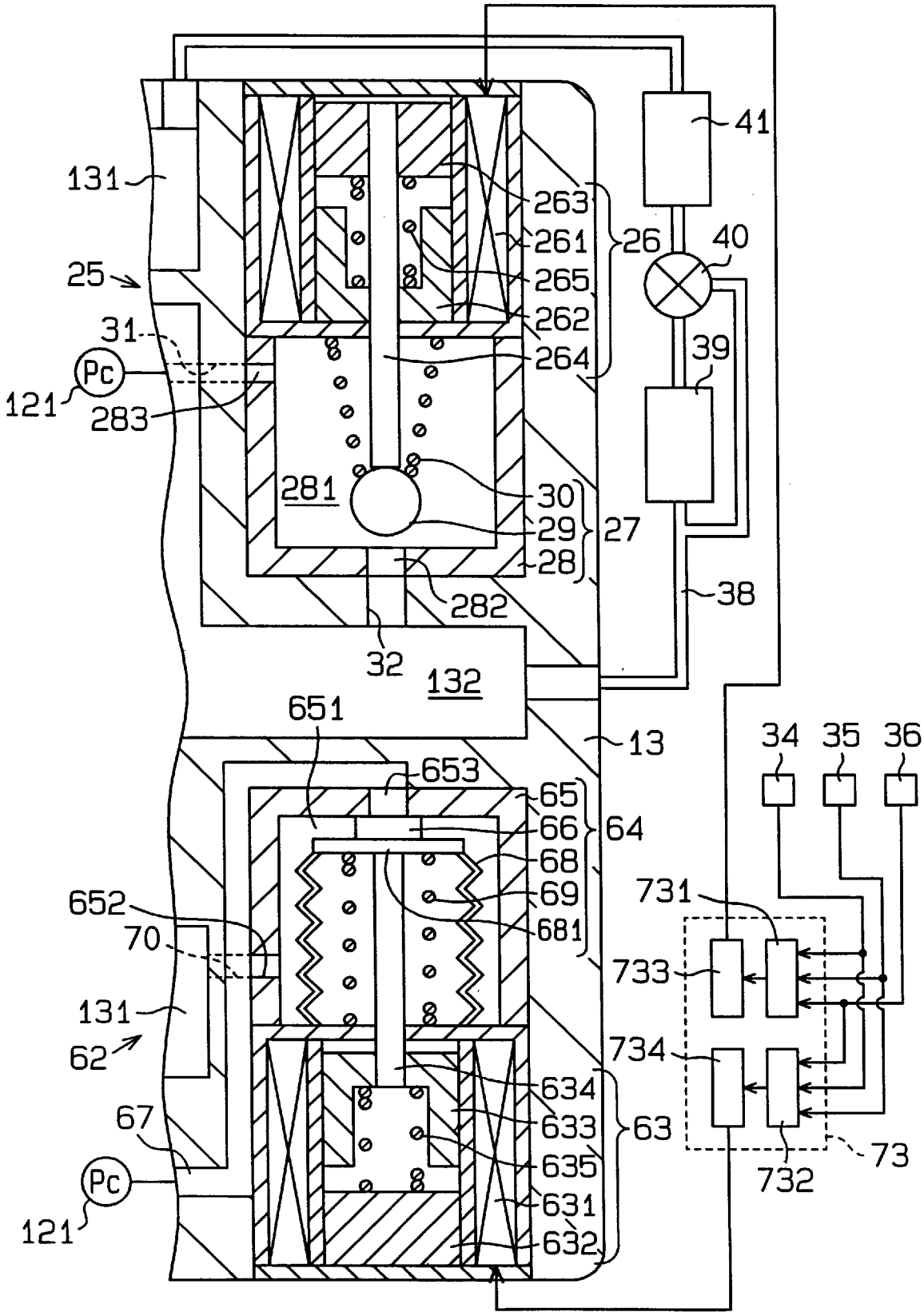
FIG. 10 is an enlarged partial cross-sectional view illustrating a compressor according to a third embodiment of the present invention.

As shown in FIG. 10, the compressor according to the third embodiment has two control valves 25, 62. The first control valve 25 has the same construction and function as the control valve 25 of FIG. 4 and controls the flow rate of refrigerant supplied from the discharge chamber 132 to the control chamber 121. Therefore, the same reference numerals are given to those components that are the same as the corresponding components of the control valve 25 of FIG. 4. The second control valve 62 controls the flow rate of refrigerant released from the control valve 121 to the suction chamber 131. Thus, the control pressure Pc in the control chamber 121 is controlled by the first control valve 25, which supplies refrigerant to the control chamber 121, and the second control valve 42, which releases refrigerant from the control chamber 121.

As illustrated in FIG. 10, the second control valve 62 includes a solenoid 63 and a valve mechanism 64. The solenoid 63 includes a coil 631, a steel fixed core 632, a steel movable core 633, a drive rod 634, which is secured to the movable core 633, and a return spring 635. The valve mechanism 64 includes a case 65, a valve chamber 651 defined in the case 65, a valve body 66 accommodated in the valve chamber 651, a bellows 68 located in the valve chamber 651 and a spring 69. The valve body 66 is coupled to the drive rod 634. The bellows 68 includes a pressure sensing plate 681, which is coupled to the drive rod 634. The spring 69 urges the plate 681 in a direction expanding the bellows 68.

The valve chamber 651 is connected to a control chamber 121 by a passage 67. The valve chamber 651 is also connected to the suction chamber 131 by a port 652 and a passage 70. When the valve body 66 opens the valve hole 653 as illustrated in FIG. 11, refrigerant in the control chamber 121 flows into the suction chamber 131 by way of the passage 67, the valve hole 653, the valve chamber 651, the port 652 and the passage 70.

The suction pressure Ps in the suction chamber 131 communicates with the valve chamber 651 by way of the passage 70 and the port 652. A force Ps1 of the suction pressure Ps in the valve chamber 651 acts on the pressure receiving plate 681. The urging force of the spring 69 acts against the force Ps1. The movable core 633 is urged toward the fixed core 632 by a force corresponding to current value supplied to the coil 631. That is, the force of the solenoid 63 acts against the force of the spring 69. The return spring 635 urges the movable core 633 away from the fixed core 632.

A resultant force (Fo+Ps1) of the force Fo of the solenoid 63 and the force Ps1 of the suction pressure Ps acting on the bellows 68 urges the valve body 66 in the direction opening the valve hole 653. A resultant force (F6+F7) of the force F6 of the return spring 635 and the force F7 of the spring 69 acts against the resultant force Fo+Ps1. That is, the resultant force F6+F7 urges the valve body 66 in the direction closing the valve hole 653. Thus, when the force Ps1 of the suction pressure Ps acting on the bellows 68 is smaller than the force E6+E7−Fo, the valve body 66 closes the valve hole 653 and stops flow of refrigerant from the control chamber 121 to the suction chamber 131. On the other hand, when the force Ps1 of the suction chamber Ps acting on the bellows 68 is greater than the force E6+E7−Fo, the valve body 66 opens the valve hole 653 and allows refrigerant to flow from the control chamber 121 to the suction chamber 131. In this manner, the second control valve 62 controls the flow of refrigerant from the control chamber 121 to the suction chamber 131.

When the current fed to the solenoid 63 is maintained at a constant value, that is, when the force Fo of the solenoid 63 is constant, the valve body 66 moves in accordance with fluctuations of the force Ps1, which is the force of the suction pressure Ps acting on the bellows 68. More specifically, a decrease in the suction pressure Ps, or a decrease in the force Ps1, causes the valve body 66 to decrease the opened area of the valve hole 653. Accordingly, the amount of refrigerant flowing from the control chamber 121 to the suction chamber 131 is decreased. This increases the control pressure Pc in the control chamber 121 thereby increasing the difference between the control pressure Pc and the suction pressure Ps. Consequently, the inclination of the swash plate 18 decreases, which reduces the displacement of the compressor such that the suction pressure Ps increases gradually.

When the suction pressure Ps increases, that is, when the force Ps1 increases, the valve body 66 increases the opened area of the valve hole 653 thereby reducing the amount of refrigerant from the control chamber 121 to the suction chamber 131. This lowers the control pressure Pc in the control chamber 121 and thus decreases the difference between the control pressure Pc and the suction pressure Ps. Consequently, the inclination of the swash plate 18 increases, which increases displacement of the compressor such that the suction pressure Ps is gradually lowered.

In this manner, the second control valve 62 functions to raise the suction pressure Ps when the pressure Ps decreases, and lowers the pressure Ps when the pressure Ps increases. In other words, the second control valve 62 functions to direct the suction pressure Ps toward a predetermined, or target level.

The control valve 62 changes the predetermined value to which the suction pressure Ps is directed, or the value of the target suction pressure, in accordance with the value of the current fed to the solenoid 63. For example, an increase in the value of the current fed to the solenoid 63 strengthens the force Fo of the solenoid 63 that urges the valve body 66 in the opening direction. This increases the opened area of the valve hole 653 and lowers the control pressure Pc in the control chamber 121. As a result, the compressor displacement increases and the suction pressure Ps decreases gradually. The control valve 62 functions to seek the lowered suction pressure Ps. In this manner, the control valve 62 seeks a lower suction pressure Ps as the value of the current fed to the solenoid 63 increases. Accordingly, the control valve 62 functions to change the target suction pressure in accordance with the value of the current fed to the solenoid 63.

A controller 73 illustrated in FIG. 10 controls supply of electric current to the solenoids 26, 63 of the control valves 25, 62. The controller 73 includes a first setter 731 for setting a target discharge pressure and a first supplier 733 for supplying a current the solenoid 26. The first supplier 733 controls the value of the current to the solenoid 26 in accordance with the target discharge pressure set by the first setter 731. The controller 73 further includes a second setter 732 for setting a target suction pressure and a second supplier 734 for supplying a current to the solenoid 63. The second supplier 734 controls the value of the current to the solenoid 63 in accordance with the target suction pressure set by the second setter 732.

Figure 12:
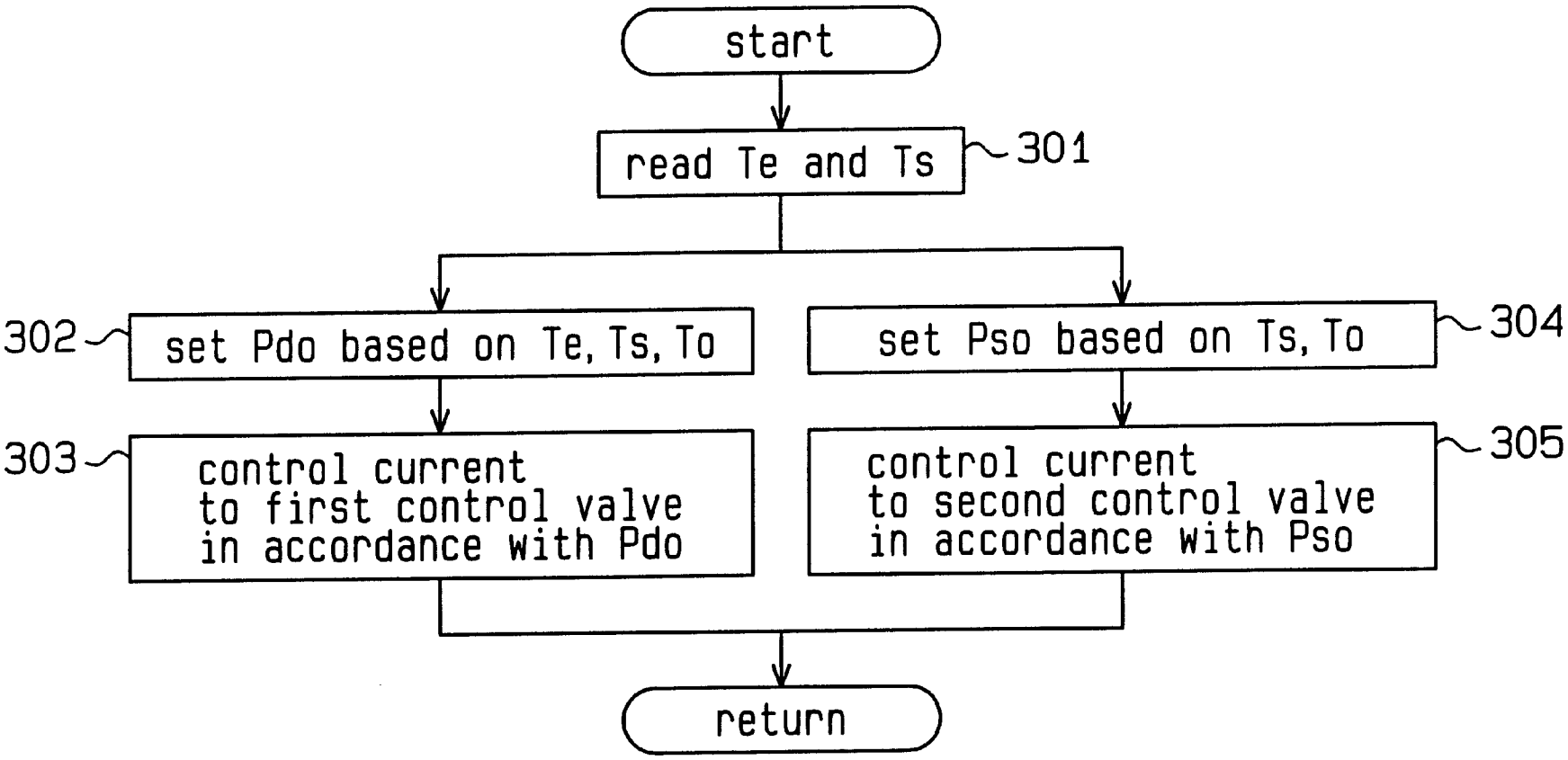
FIG. 12 is a flowchart illustrating a program for controlling the compressor of FIG. 10.

The controller 73 performs a program in FIG. 12 for controlling the compressor. The first setter 731 samples the outside temperature Te detected by the outside temperature sensor 34 and the compartment temperature Ts detected by the compartment temperature sensor 35 at every predetermined interval. The second setter 732 samples the compartment temperature Ts detected by the compartment temperature sensor 35 at every predetermined interval.

As shown in FIG. 12, the first setter 731 reads the sampled outside temperature Te and the sampled compartment temperature Ts at step 301. At step 302, the first setter 731 sets a target discharge pressure Pdo based on the outside temperature Te, the compartment temperature Ts and a target compartment temperature To set by the temperature adjuster 36. At a subsequent step 303, the first supplier 733 controls the current supplied to the solenoid 26 of the first control valve 25 in accordance with the target discharge pressure Pdo. The target discharge pressure Pdo and the current supplied to the solenoid 26 are determined in the same routine, for example, as the routine shown in FIG. 7.

The second setter 732 reads the sampled compartment temperature Ts at step 301. At step 304, the second setter 732 sets a target suction pressure Pso based on the compartment temperature Ts and the target compartment temperature To. At a subsequent step 305, the second supplier 734 controls the current supplied to the solenoid 63 of the second control valve 62 in accordance with the target suction pressure Pso. The target discharge pressure Pso and the current supplied to the solenoid 63 are determined in the same routine, for example, as the routine shown in FIG. 9.

In this manner, the first control valve 25 functions to seek the target discharge pressure Pdo determined by the current supplied thereto, and the second control valve 62 functions to seek the target suction pressure Pso determined by the current supplied thereto.

The compartment temperature is preferably controlled as finely as possible. The second control valve 62, which controls the suction pressure Ps, enables a fine control of the compartment temperature but is not suitable for adjusting the compressor displacement when there is great fluctuations of the rotational speed of the compressor's drive shaft 14. On the other hand, the first control valve 25, which controls the discharge pressure Pd, is suitable for controlling the compressor displacement when the speed of the compressor's drive shaft 14 greatly fluctuates. However, the control valve 25 is not suitable for finely controlling the compartment temperature. In the embodiment of FIGS. 10–12, the two control valves 25, 62 are used for controlling the discharge pressure Pd and the suction pressure Ps, respectively. That is, the first control valve 25 controls the discharge pressure, which is influenced by speed fluctuations of the compressor's drive shaft 14, whereas the second control valve 62 controls the suction pressure, which is influenced by fluctuations of the compartment temperature. This construction reduces the power consumption of the compressor and enables satisfactory refrigeration.

Figure 11:
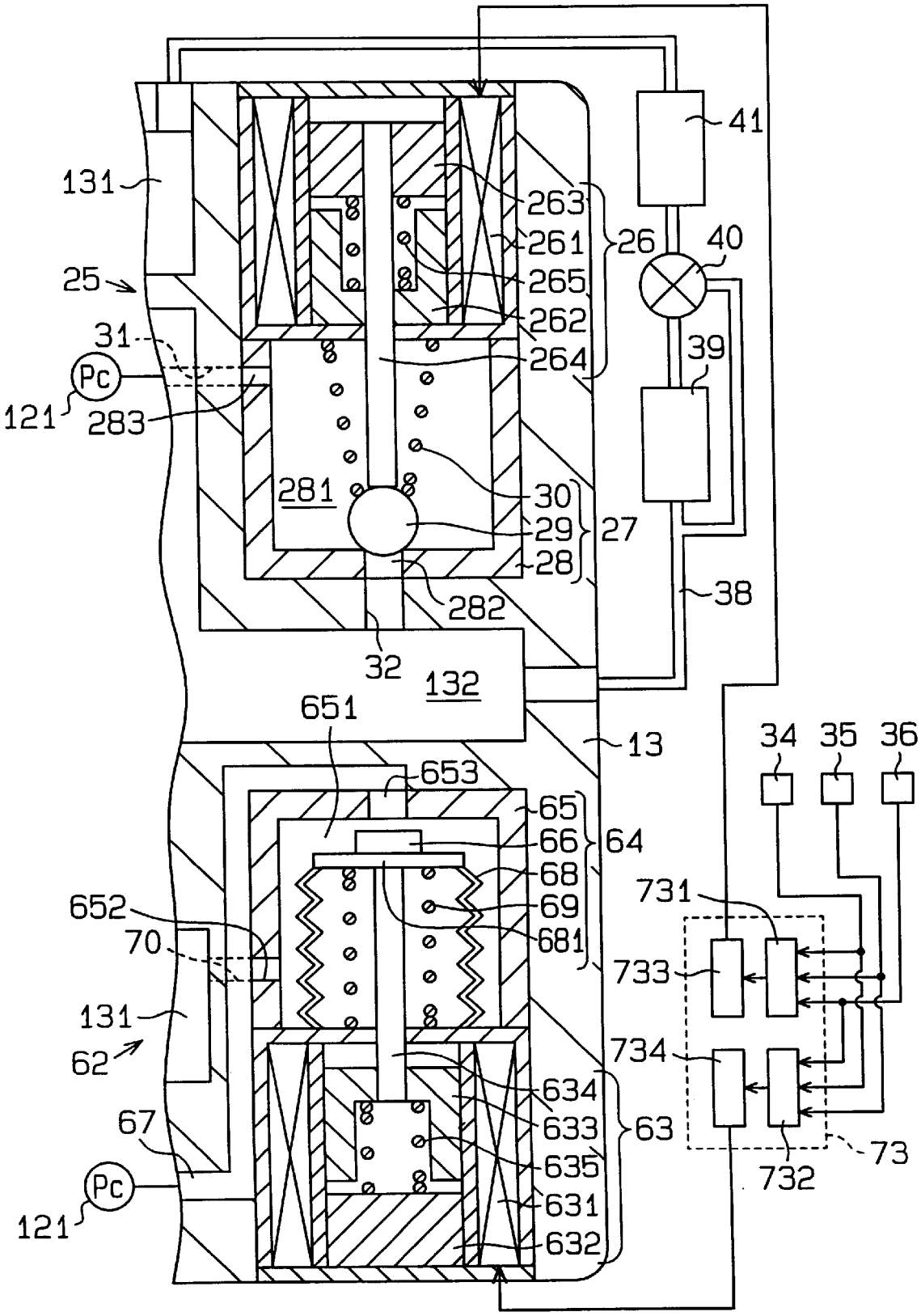
FIG. 11 is an enlarged partial cross-sectional view illustrating the compressor according to the third embodiment.

The compressor of FIGS. 10–12 shares the other advantages with the compressors of FIGS. 1–9.

A fourth embodiment of the present invention will now be described with reference to FIG. 13. The third embodiment is a modification of the compressor of FIGS. 10–12. Like or the same reference numerals are given to those components that are like or the same as the corresponding components of the compressor of FIG. 10.

Figure 13:
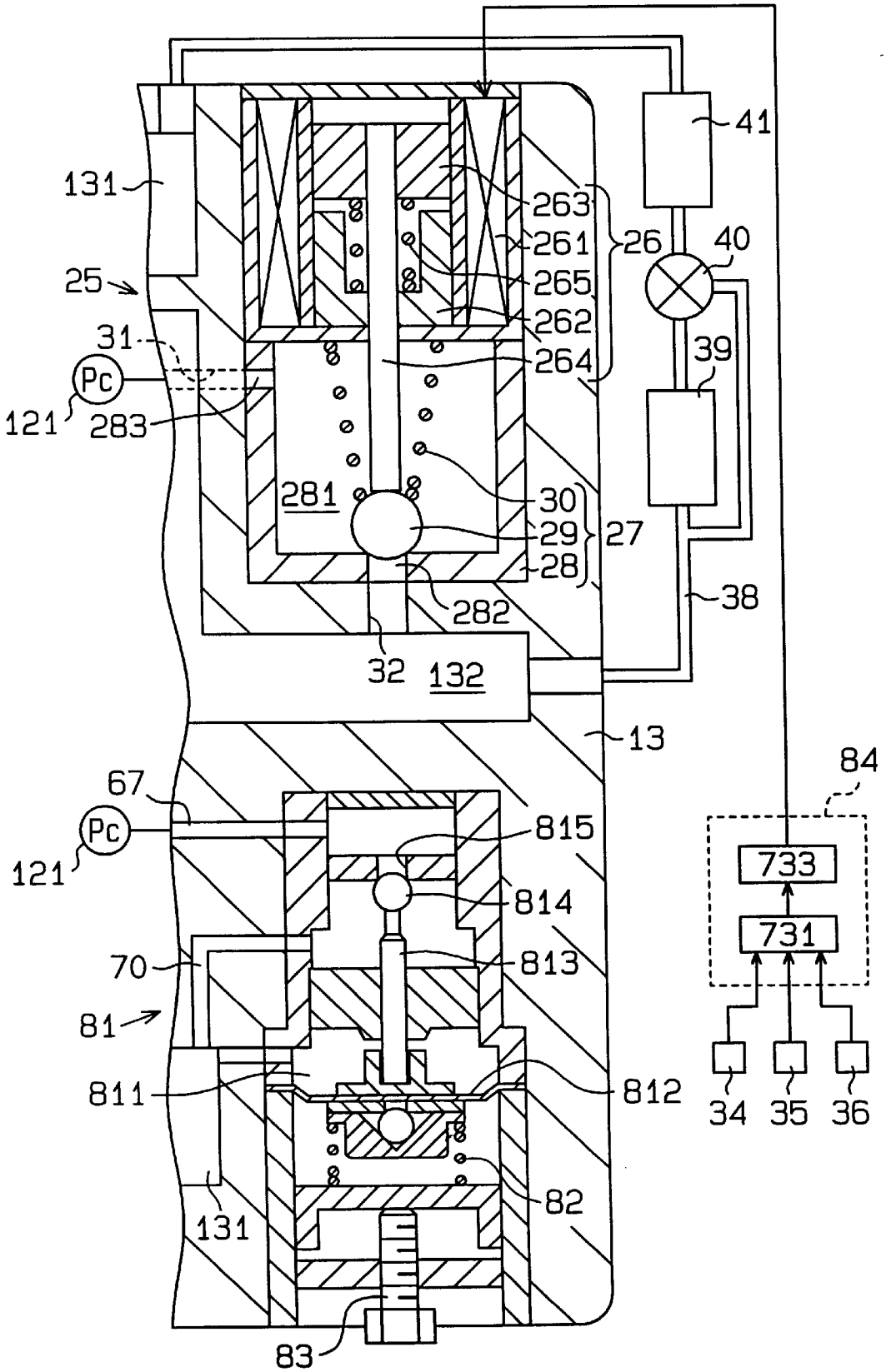
FIG. 13 is an enlarged partial cross-sectional view illustrating a compressor according to a fourth embodiment of the present invention.

As illustrated in FIG. 13, the compressor according to the fourth embodiment has a different second control 81 valve from that of FIG. 10. That is, the second control valve 81 includes a pressure sensing chamber 811. The suction pressure Ps in the suction chamber 131 is communicated with the pressure sensing chamber 811. The force of the suction pressure in the chamber 811 acts against the force of a spring 82 through a diaphragm 812. The force of the spring 82 can be adjusted by changing the axial position of a screw 83. The diaphragm 812 is displaced in accordance with the difference between the suction pressure Ps in the pressure sensing chamber 811 and the force of the spring 82. The displacement of the diaphragm 813 is transmitted to a valve body 814. The valve body 814, in turn, changes the opened area of a valve hole 815 thereby controlling the flow rate of refrigerant from the control chamber 121 to the suction chamber 131. Consequently, the suction pressure Ps is directed toward a target value.

The second control valve 81 according to the fourth embodiment functions substantially in the same manner as the control valve 62 of FIG. 10. The difference is that the target suction pressure is set by adjusting the force of the spring 82 and not by a solenoid. The first control valve 25 is controlled in the same manner as in the compressor of FIGS. 10–12 by a controller 84, which includes the first setter 331 and the first supplier 333.

A fifth embodiment of the present invention will now be described with reference to FIG. 14. The compressor FIG. 14 has first and second control valves. The first control valve is the same as the first control valve 25 of FIG. 10 and the second control valve is the same as the control valve 42 of FIG. 8. Therefore, as for the controls valves like or the same reference numerals are given to those components that are like or the same as the corresponding components of the control valve 25 of FIG. 10 and control valve 42 of FIG. 8.

The first control valve 25 controls the flow rate of refrigerant from the discharge chamber 132 to the control chamber 121 thereby maintaining the discharge pressure at a target value. The second control value 42 controls the flow rate of refrigerant from the discharge chamber 132 to the control chamber 121 thereby maintaining the suction pressure at a target value. That is, the first and second control valves 25, 42 of FIG. 14 both control the flow rate of refrigerant from the discharge chamber 132 to the control chamber 121. The second control valve 42 is connected to the discharge chamber 132 by way of a passage 32'. The second control valve 42 is connected to the control chamber 121 by way of a passage 31'. Refrigerant in the control chamber 121 is released to the suction chamber 131 by way of the passage 113 (see FIG. 1).

A controller 95 includes a first setter 951 for setting a target discharge pressure and a first supplier 953 for supplying a current to the solenoid 26 of the first control valve 25. The first supplier 953 controls the value of the current to the solenoid 26 in accordance with the target discharge pressure set by the first setter 951. The controller 95 also includes a second setter 952 for setting a target suction pressure and a second supplier 954 for supplying a current to the solenoid 43 of the second control valve 42. The second supplier 954 controls the value of the current to the solenoid 43 in accordance with the target suction pressure set by the second setter 952.

The first setter 951 sets a target discharge pressure Pdo based on the outside temperature Te detected by the outside temperature sensor 34. The first supplier 953 controls the current supplied to the solenoid 26 of the first control valve 25 based on the target discharge pressure Pdo.

The second setter 952 determines a target suction pressure Pso based on the compartment temperature Ts detected by the compartment temperature sensor 35 and a target compartment temperature To set by the temperature adjuster 36. The second supplier 954 controls the current supplied to the solenoid 43 of the second control valve 42 based on the target suction pressure Pso. The target suction pressure Pso and the current supplied to the solenoid 43 are determined in the same routine, for example, as the routine shown in FIG. 9.

In this manner, the first control valve 25 functions to obtain the target discharge pressure Pdo determined by a current supplied thereto, and the second control valve 42 functions to obtain the target suction pressure Pso determined by a current supplied thereto.

Figure 14:
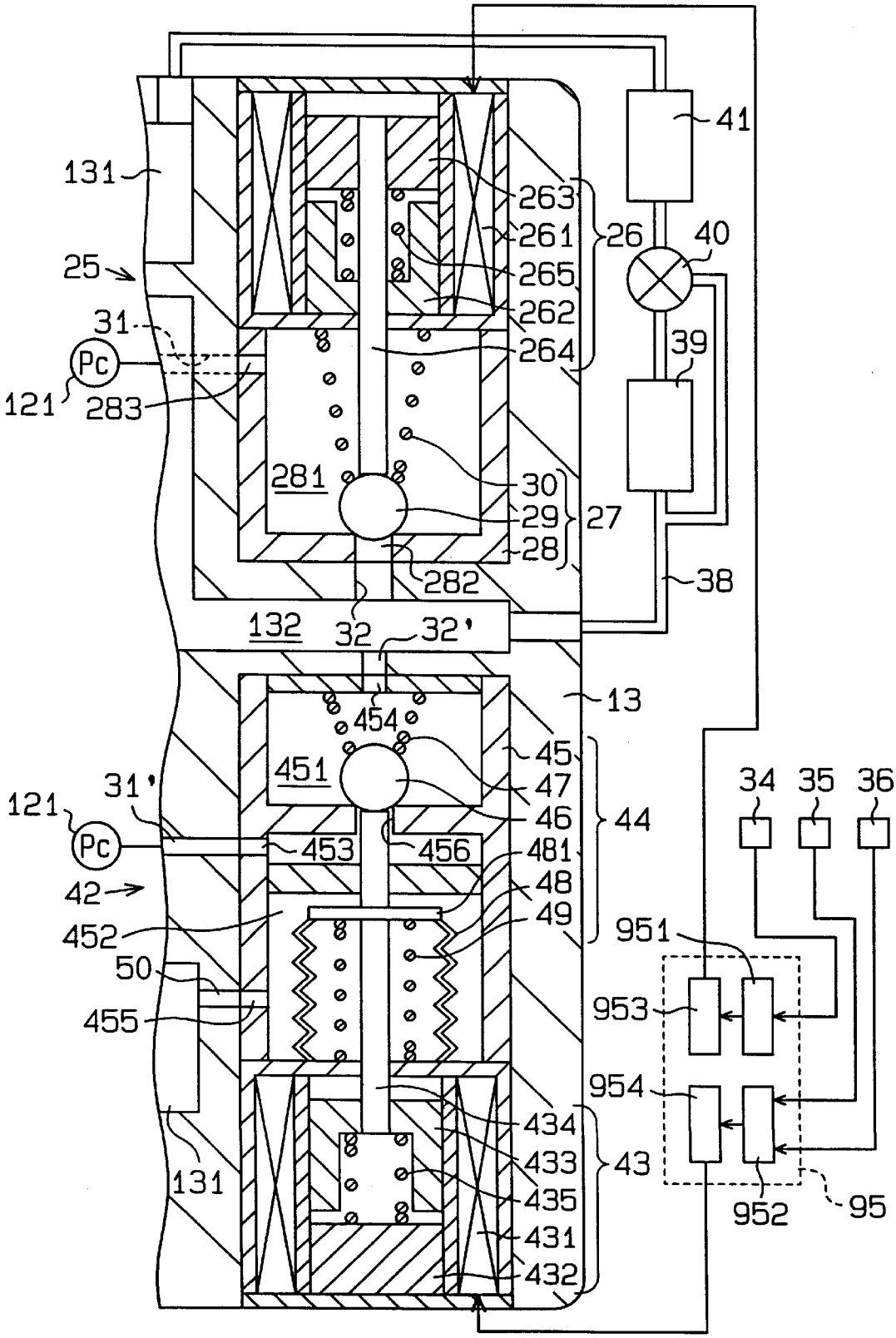
FIG. 14 is an enlarged partial cross-sectional view illustrating a compressor according to a fifth embodiment of the present invention.

The compressor of FIG. 14 has substantially the same advantages as the compressor of FIGS. 10–12.

It should be apparent to those skilled in the art that the present invention may be embodied in many other specific forms without departing from the spirit or scope of the invention. For example, the present invention may be embodied as described below.

The intervals for sampling the outside temperature may be longer than the intervals for sampling the compartment temperature.

The flow rate of refrigerant from the discharge chamber 132 to the control chamber 121 may be maintained at a constant level, and only the flow rate of refrigerant released from the control chamber 121 to the suction chamber 131 may be controlled by a control valve that functions to maintain the discharge pressure or the suction pressure at a target value.

The control valves may be electromagnetic valves that simply selectively open and close.

Therefore, the present examples and embodiments are to be considered as illustrative and not restrictive and the invention is not to be limited to the details given herein, but may be modified within the scope and equivalence of the appended claims.

What is claimed is:

1. A variable displacement compressor used in a refrigeration circuit that performs heat exchange at temperatures above and below the critical temperature of refrigerant, the compressor comprising:

a suction pressure zone, the pressure of which is the pressure of refrigerant drawn into the compressor from a refrigeration circuit;

a discharge pressure zone, the pressure of which is the pressure of refrigerant discharged from the compressor into the refrigeration circuit;

a control chamber, the pressure of which is a control pressure;

a control valve that controls the difference between the control pressure in the control chamber and the suction pressure in the suction pressure zone thereby controlling the compressor displacement, which represents the flow rate of refrigerant in the refrigeration circuit, wherein the control valve controls at least one of the flow rate of refrigerant supplied from the discharge pressure zone to the control chamber and the flow rate of refrigerant released from the control chamber to the suction pressure zone thereby controlling the difference between the control pressure and the suction pressure;

means for obtaining information required for controlling the compressor displacement from outside of the refrigeration circuit;

means for setting a target value of flow rate of refrigerant in the refrigeration circuit in accordance with the information; and a controller for controlling the control valve such that the target value is sought.

2. A variable displacement compressor used in a refrigeration circuit that performs heat exchange at temperatures above and below the critical temperature of refrigerant, the compressor comprising:

a suction pressure zone, the pressure of which is the pressure of refrigerant drawn into the compressor from a refrigeration circuit;

a discharge pressure zone, the pressure of which is the pressure of refrigerant discharged from the compressor into the refrigeration circuit;

a control chamber, the pressure of which is a control pressure;

a control valve that controls the difference between the control pressure in the control chamber and the suction pressure in the suction pressure zone thereby controlling the compressor displacement, which represents the flow rate of refrigerant in the refrigeration circuit, wherein the control valve controls at least one of the flow rate of refrigerant supplied from the discharge pressure zone to the control chamber and the flow rate of refrigerant released from the control chamber to the suction pressure zone thereby controlling the difference between the control pressure and the suction pressure;

means for obtaining information required for controlling the compressor displacement from outside of the refrigeration circuit;

means for setting a target value of flow rate of refrigerant in the refrigeration circuit in accordance with the information;

a controller for controlling the control valve such that the target value is sought; and wherein the obtaining means determines thermal load acting on the refrigeration circuit based on the information.

3. A variable displacement compressor used in a refrigeration circuit that performs heat exchange at temperatures above and below the critical temperature of refrigerant, the compressor comprising:

a suction pressure zone, the pressure of which is the pressure of refrigerant drawn into the compressor from a refrigeration circuit;

a discharge pressure zone, the pressure of which is the pressure of refrigerant discharged from the compressor into the refrigeration circuit;

a control chamber, the pressure of which is a control pressure;

a control valve that controls the difference between the control pressure in the control chamber and the suction pressure in the suction pressure zone thereby controlling the compressor displacement, which represents the flow rate of refrigerant in the refrigeration circuit, wherein the control valve controls at least one of the flow rate of refrigerant supplied from the discharge pressure zone to the control chamber and the flow rate of refrigerant released from the control chamber to the suction pressure zone thereby controlling the difference between the control pressure and the suction pressure;

means for obtaining information required for controlling the compressor displacement from outside of the refrigeration circuit;

means for setting a target value of flow rate of refrigerant in the refrigeration circuit in accordance with the information;

a controller for controlling the control valve such that the target value is sought; and wherein the obtaining means includes a detector for detecting outside temperature, and wherein the outside temperature is included in the information.

4. The compressor according to claim 3, wherein the obtaining means further includes a detector for detecting the temperature of a compartment that is air-conditioned by the refrigeration circuit and a temperature setter for setting a target value of the compartment temperature, and wherein the detected compartment temperature and the target value are included in the information.

5. The compressor according to claim 4, wherein the target flow rate setting means determines a provisional target value of the flow rate of refrigerant based on the detected outside temperature, and wherein the target flow rate setting means corrects the provisional target value based on a comparison between the detected compartment temperature with the target value of the compartment temperature thereby determining an actual target value of the flow rate of refrigerant.

6. A variable displacement compressor used in a refrigeration circuit that performs heat exchange at temperatures above and below the critical temperature of refrigerant, the compressor comprising:

a suction pressure zone, the pressure of which is the pressure of refrigerant drawn into the compressor from a refrigeration circuit;

a discharge pressure zone, the pressure of which is the pressure of refrigerant discharged from the compressor into the refrigeration circuit;

a control chamber, the pressure of which is a control pressure;

a control valve that controls the difference between the control pressure in the control chamber and the suction pressure in the suction pressure zone thereby controlling the compressor displacement, which represents the flow rate of refrigerant in the refrigeration circuit, wherein the control valve controls at least one of the flow rate of refrigerant supplied from the discharge pressure zone to the control chamber and the flow rate of refrigerant released from the control chamber to the suction pressure zone thereby controlling the difference between the control pressure and the suction pressure;

means for obtaining information required for controlling the compressor displacement from outside of the refrigeration circuit;

means for setting a target value of flow rate of refrigerant in the refrigeration circuit in accordance with the information;

a controller for controlling the control valve such that the target value is sought; and wherein the control valve functions to maintain the pressure of refrigerant discharged from the compressor into the refrigeration circuit at a predetermined target discharge pressure value, and wherein the target flow rate setting means sets the target discharge pressure as a target value of the flow rate of refrigerant in the refrigeration circuit.

7. A variable displacement compressor used in a refrigeration circuit that performs heat exchange at temperatures above and below the critical temperature of refrigerant, the compressor comprising:

a suction pressure zone, the pressure of which is the pressure of refrigerant drawn into the compressor from a refrigeration circuit;

a discharge pressure zone, the pressure of which is the pressure of refrigerant discharged from the compressor into the refrigeration circuit;

a control chamber, the pressure of which is a control pressure;

a control valve that controls the difference between the control pressure in the control chamber and the suction pressure in the suction pressure zone thereby controlling the compressor displacement, which represents the flow rate of refrigerant in the refrigeration circuit, wherein the control valve controls at least one of the flow rate of refrigerant supplied from the discharge pressure zone to the control chamber and the flow rate of refrigerant released from the control chamber to the suction pressure zone thereby controlling the difference between the control pressure and the suction pressure;

means for obtaining information required for controlling the compressor displacement from outside of the refrigeration circuit;

means for setting a target value of flow rate of refrigerant in the refrigeration circuit in accordance with the information;

a controller for controlling the control valve such that the target value is sought; and wherein the control valve functions to maintain the pressure of refrigerant drawn into the compressor from the refrigeration circuit at a predetermined target suction pressure value, and wherein the target flow rate setting means sets the target suction pressure as a target value of the flow rate of refrigerant in the refrigeration circuit.

8. The compressor according to claim 1, wherein the control valve includes a first control valve and a second control valve, and wherein the controller controls at least one of the control valves.

9. A variable displacement compressor used in a refrigeration circuit that performs heat exchange at temperatures above and below the critical temperature of refrigerant, the compressor comprising:

a suction pressure zone, the pressure of which is the pressure of refrigerant drawn into the compressor from a refrigeration circuit;

a discharge pressure zone, the pressure of which is the pressure of refrigerant discharged from the compressor into the refrigeration circuit;

a control chamber, the pressure of which is a control pressure;

a control valve that controls the difference between the control pressure in the control chamber and the suction pressure in the suction pressure zone thereby controlling the compressor displacement, which represents the flow rate of refrigerant in the refrigeration circuit, wherein the control valve controls at least one of the flow rate of refrigerant supplied from the discharge pressure zone to the control chamber and the flow rate of refrigerant released from the control chamber to the suction pressure zone thereby controlling the difference between the control pressure and the suction pressure;

means for obtaining information required for controlling the compressor displacement from outside of the refrigeration circuit;

means for setting a target value of flow rate of refrigerant in the refrigeration circuit in accordance with the information;

a controller for controlling the control valve such that the target value is sought;

wherein the control valve includes a first control valve and a second control valve, and wherein the controller controls at least one of the control valves; and wherein the first control valve functions to maintain the pressure of refrigerant discharged from the compressor into the refrigeration circuit at a predetermined target discharge pressure value, and wherein the target flow rate setting means sets the target discharge pressure as a target value of the flow rate of refrigerant in the refrigeration circuit.

10. The compressor according to claim 9, wherein the obtaining means includes a detector for detecting outside temperature, and wherein the outside temperature is included in the information.

11. The compressor according to claim 10, wherein the obtaining means further includes a detector for detecting the temperature of a compartment that is air-conditioned by the refrigeration circuit and a temperature setter for setting a target value of the compartment temperature, and wherein the detected compartment temperature and the target value are included in the information.

12. The compressor according to claim 11, wherein the target flow rate setting means determines a provisional target value of the pressure of refrigerant discharged from the compressor based on the detected outside temperature, and wherein the target flow rate setting means corrects the provisional target value based on a comparison between the detected compartment temperature with the target value of the compartment temperature thereby determining an actual target value of the discharge pressure.

13. A variable displacement compressor used in a refrigeration circuit that performs heat exchange at temperatures above and below the critical temperature of refrigerant, the compressor comprising:

a suction pressure zone, the pressure of which is the pressure of refrigerant drawn into the compressor from a refrigeration circuit;

a discharge pressure zone, the pressure of which is the pressure of refrigerant discharged from the compressor into the refrigeration circuit;

a control chamber, the pressure of which is a control pressure;

a control valve that controls the difference between the control pressure in the control chamber and the suction pressure in the suction pressure zone thereby controlling the compressor displacement, which represents the flow rate of refrigerant in the refrigeration circuit, wherein the control valve controls at least one of the flow rate of refrigerant supplied from the discharge pressure zone to the control chamber and the flow rate of refrigerant released from the control chamber to the suction pressure zone thereby controlling the difference between the control pressure and the suction pressure;

means for obtaining information required for controlling the compressor displacement from outside of the refrigeration circuit;

means for setting a target value of flow rate of refrigerant in the refrigeration circuit in accordance with the information;

a controller for controlling the control valve such that the target value is sought;

wherein the control valve includes a first control valve and a second control valve, and wherein the controller controls at least one of the control valves; and wherein the second control valve functions to maintain the pressure of refrigerant drawn into the compressor from the refrigeration circuit at a predetermined target suction pressure value, and wherein the target flow rate setting means sets the target suction pressure as a target value of the flow rate of refrigerant in the refrigeration circuit.

14. The compressor according to claim 13, wherein the obtaining means includes a detector for detecting the temperature of a compartment that is air-conditioned by the refrigeration circuit and a temperature setter for setting a target value of the compartment temperature, and wherein the detected compartment temperature and the target value are included in the information.

15. The compressor according to claim 14, wherein the target flow rate setting means determines a provisional target value of the pressure of refrigerant drawn into the compressor based on the detected compartment temperature, and wherein the target flow rate setting means corrects the provisional target value based on a comparison between the detected compartment temperature with the target value of the compartment temperature thereby determining an actual target value of the suction pressure.

16. A variable displacement compressor used in a refrigeration circuit that performs heat exchange at temperatures above and below the critical temperature of refrigerant, the compressor comprising:

a suction pressure zone, the pressure of which is the pressure of refrigerant drawn into the compressor from a refrigeration circuit;

a discharge pressure zone, the pressure of which is the pressure of refrigerant discharged from the compressor into the refrigeration circuit;

a control chamber, the pressure of which is a control pressure;

a control valve that controls the difference between the control pressure in the control chamber and the suction pressure in the suction pressure zone thereby controlling the compressor displacement, which represents the flow rate of refrigerant in the refrigeration circuit, wherein the control valve controls at least one of the flow rate of refrigerant supplied from the discharge pressure zone to the control chamber and the flow rate of refrigerant released from the control chamber to the suction pressure zone thereby controlling the difference between the control pressure and the suction pressure;

means for obtaining information required for controlling the compressor displacement from outside of the refrigeration circuit;

means for setting a target value of flow rate of refrigerant in the refrigeration circuit in accordance with the information;

a controller for controlling the control valve such that the target value is sought;

wherein the control valve includes a first control valve and a second control valve, and wherein the controller controls at least one of the control valves; and wherein the first control valve controls the flow rate of refrigerant supplied from the discharge pressure zone to the control chamber, and wherein the second control valve controls the flow rate of refrigerant released from the control chamber to the suction pressure zone.

17. A variable displacement compressor used in a refrigeration circuit that performs heat exchange at temperatures above and below the critical temperature of refrigerant, the compressor comprising:

a suction pressure zone, the pressure of which is the pressure of refrigerant drawn into the compressor from a refrigeration circuit;

a discharge pressure zone, the pressure of which is the pressure of refrigerant discharged from the compressor into the refrigeration circuit;

a control chamber, the pressure of which is a control pressure;

a control valve that controls the difference between the control pressure in the control chamber and the suction pressure in the suction pressure zone thereby controlling the compressor displacement, which represents the flow rate of refrigerant in the refrigeration circuit, wherein the control valve controls at least one of the flow rate of refrigerant supplied from the discharge pressure zone to the control chamber and the flow rate of refrigerant released from the control chamber to the suction pressure zone thereby controlling the difference between the control pressure and the suction pressure;

means for obtaining information required for controlling the compressor displacement from outside of the refrigeration circuit;

means for setting a target value of flow rate of refrigerant in the refrigeration circuit in accordance with the information;

a controller for controlling the control valve such that the target value is sought; and wherein the control valve includes a solenoid, wherein the controller supplies a current to the solenoid, and wherein the value of the current corresponds to the target value of the flow rate of refrigerant in the refrigeration circuit.

18. The compressor according to claim 1, wherein the refrigerant is carbon dioxide.

19. A variable displacement compressor used in a refrigeration circuit that performs heat exchange at temperatures above and below the critical temperature of refrigerant, the compressor comprising:

a suction pressure zone, the pressure of which is the pressure of refrigerant drawn into the compressor from a refrigeration circuit;

a discharge pressure zone, the pressure of which is the pressure of refrigerant discharged from the compressor into the refrigeration circuit;

a control chamber, the pressure of which is a control pressure;

a first control valve and a second control valve that control the difference between the control pressure in the control chamber and the suction pressure in the suction pressure zone thereby controlling the compressor displacement, which represents the flow rate of refrigerant in the refrigeration circuit, wherein the first control valve functions to maintain the pressure of refrigerant discharged from the compressor into the refrigeration circuit at a predetermined first target value, and wherein the second control valve functions to maintain the pressure of refrigerant drawn into the compressor from the refrigeration circuit at a predetermined second target value;

a first detector for detecting the outside temperature;

a second detector for detecting the temperature of a compartment that is air-conditioned by the refrigeration circuit;

first setting means for setting the first target value in accordance with the detected outside temperature;

second setting means for setting the second target value in accordance with the detected compartment temperature;

a first controller for controlling the first control valve such that the first target value is sought; and a second controller for controlling the second control valve such that the second target value is sought.

20. A method for controlling a variable displacement compressor used in a refrigeration circuit that performs heat exchange at temperatures above and below the critical temperature of refrigerant, wherein the compressor includes a suction pressure zone, the pressure of which is the pressure of refrigerant drawn into the compressor from a refrigeration circuit, a discharge pressure zone, the pressure of which is the pressure of refrigerant discharged from the compressor into the refrigeration circuit, and a control chamber, the pressure of which is a control pressure, the method including steps of:

controlling the difference between the control pressure in the control chamber and the suction pressure in the suction pressure zone using a control valve thereby controlling the compressor displacement, which represents the flow rate of refrigerant in the refrigeration circuit;

obtaining information required for controlling the compressor displacement from outside of the refrigeration circuit;

setting a target value of flow rate of refrigerant in the refrigeration circuit in accordance with the information; and controlling the control valve such that the target value is sought.

21. A method for controlling a variable displacement compressor used in a refrigeration circuit that performs heat exchange at temperatures above and below the critical temperature of refrigerant, wherein the compressor includes a suction pressure zone, the pressure of which is the pressure of refrigerant drawn into the compressor from a refrigeration circuit, a discharge pressure zone, the pressure of which is the pressure of refrigerant discharged from the compressor into the refrigeration circuit, and a control chamber, the pressure of which is a control pressure, the method including steps of:

controlling the difference between the control pressure in the control chamber and the suction pressure in the suction pressure zone using a first control valve and a second control valve thereby controlling the compressor displacement, which represents the flow rate of refrigerant in the refrigeration circuit, wherein the first control valve functions to maintain the pressure of refrigerant discharged from the compressor into the refrigeration circuit at a predetermined first target value, and wherein the second control valve functions to maintain the pressure of refrigerant drawn into the compressor from the refrigeration circuit at a predetermined second target value;

detecting the outside temperature;

detecting the temperature of a compartment that is air-conditioned by the refrigeration circuit;

setting the first target value in accordance with the detected outside temperature;

setting the second target value in accordance with the detected compartment temperature;

controlling the first control valve such that the first target value is sought; and controlling the second control valve such that the second target value is sought.

* * * * *

UNITED STATES PATENT AND TRADEMARK OFFICE

CERTIFICATE OF CORRECTION

PATENT NO. : 6,138,468
DATED : October 31, 2000
INVENTOR(S) : Naoya Yokomachi et al.

It is certified that error appears in the above-identified patent and that said Letters Patent is hereby corrected as shown below:

Title page,
Under item [56], References Cited,
U.S. DOCUMENTS, add:
-- 5,685,160 11/1997 Abersfelder, et al --;

FOREIGN PATENT DOCUMENTS
-- 8-110104 4/1996 Japan --;

U.S. DOCUMENTS, please change:
"5014,522 5/1991 Noji et al" to -- 5014,522 4/1991 Noji et al --;

Column 12,
Line 7, change "than the lowest the value" to -- than the lowest of the value --.

Signed and Sealed this

Thirteenth Day of August, 2002

*Attest:*

*Attesting Officer*

JAMES E. ROGAN
*Director of the United States Patent and Trademark Office*